US007683852B2

(12) United States Patent
Mohamadi

(10) Patent No.: US 7,683,852 B2
(45) Date of Patent: Mar. 23, 2010

(54) ULTRA-WIDEBAND PULSE SHAPING FOR WIRELESS COMMUNICATIONS

(76) Inventor: Farrokh Mohamadi, 8 Halley, Irvine, CA (US) 92612-3797

( * ) Notice: Subject to any disclaimer, the term of this patent is extended or adjusted under 35 U.S.C. 154(b) by 935 days.

(21) Appl. No.: 11/454,915

(22) Filed: Jun. 16, 2006

(65) Prior Publication Data

US 2007/0146207 A1 Jun. 28, 2007

Related U.S. Application Data

(63) Continuation-in-part of application No. 11/182,344, filed on Jul. 15, 2005, now Pat. No. 7,321,339, which is a continuation-in-part of application No. 11/141,283, filed on May 31, 2005, now Pat. No. 7,312,763.

(60) Provisional application No. 60/765,846, filed on Feb. 7, 2006, provisional application No. 60/754,250, filed on Dec. 27, 2005, provisional application No. 60/721,204, filed on Sep. 28, 2005, provisional application No. 60/721,164, filed on Sep. 27, 2005, provisional application No. 60/693,555, filed on Jun. 24, 2005, provisional application No. 60/643,989, filed on Jan. 14, 2005.

(51) Int. Cl.
*H01Q 21/00* (2006.01)

(52) U.S. Cl. ..... 343/853; 343/700 MS; 343/852

(58) Field of Classification Search ..... 343/700 MS, 343/850, 852, 853, 858, 859, 860, 861
See application file for complete search history.

(56) References Cited

U.S. PATENT DOCUMENTS 3,114,909 A * 12/1963 Varela ..... 342/95
5,751,249 A * 5/1998 Baltus et al. ..... 342/372
6,870,503 B2 3/2005 Mohamadi
6,885,344 B2 4/2005 Mohamadi
6,963,307 B2 11/2005 Mohamadi
7,554,504 B2 * 6/2009 Mohamadi ..... 343/776
2003/0107517 A1 * 6/2003 Ikeda et al. ..... 342/372

OTHER PUBLICATIONS

Farrokh Mohamadi, A Proposed Completely Electronically Controlled Beamforming Technology for Coverage Enhancement, IEEE, Mar. 2005, USA.
Wolfgang Winkler, Johannes Borngraber, Bernd Heinemann, Frank Herzel, A Fully Integrated BICMOS PLL for 60 GHz Wireless Applications, ISSCC, Feb. 9, 2005, Session 21.
Scott Reynolds, Brian Floyd, Ullrich Pfeiffer, Thomas Zwick, 60GHz Wireless Applications, ISSCC, Feb. 18, 2004, Session 24, Yorktown Heights, NY.
Brian M. Ballweber, Ravi Gupta, David J. Allstot, A Fully Integrated 0.5-5.5-GHz CMOS Distributed Amplifier, IEEE Transactions on Solid-State Circuits, Feb. 2000, vol. 35.
Herbert Zirath, Toru Masuda, Rumen Kozhuharov, Mattias Ferndahl, Development of 60-GHz Front-End Circuits for High-Data-Rate Communication System, IEEE Journal, Oct. 2004 vol. 39.

(Continued)

*Primary Examiner*—HoangAnh T Le
(74) *Attorney, Agent, or Firm*—Haynes & Boone, LLP.

(57) ABSTRACT

In one embodiment, an impulse radio is provided that includes: a signal source operable to provide a sinusoidal source signal; a pulse shaping circuit having a plurality of selectable delay paths, the pulse shaping circuit being configured to rectify and level shift the sinusoidal source signal through selected ones of the selectable delay paths to provide an impulse signal output; a substrate; a plurality of antennas adjacent the substrate; an RF feed network adjacent the substrate and coupled to the pulse shaping circuit, the RF feed network being configured to transmit the impulse signal output to the plurality of antennas, and a distributed plurality of amplifiers integrated with the substrate and operable to amplify the impulse signal output propagated through RF feed network.

16 Claims, 25 Drawing Sheets

OTHER PUBLICATIONS

Alireza Zolfaghari, Behzad Razavi, A Low-Power 2.4 GHz Transmitter/Reciever CMOS IC, IEEE Journal of Solid-State Circuits, Feb. 2003, 176-183, vol. 28 No. 2.

Bendik Kleveland, et al., Exploiting CMOS Reverse Interconnect Scaling in Multigigahertz Amplifier and Oscillator Design, IEEE Journal of Solid-State Circuits, Oct. 2001, vol. 36.

* cited by examiner

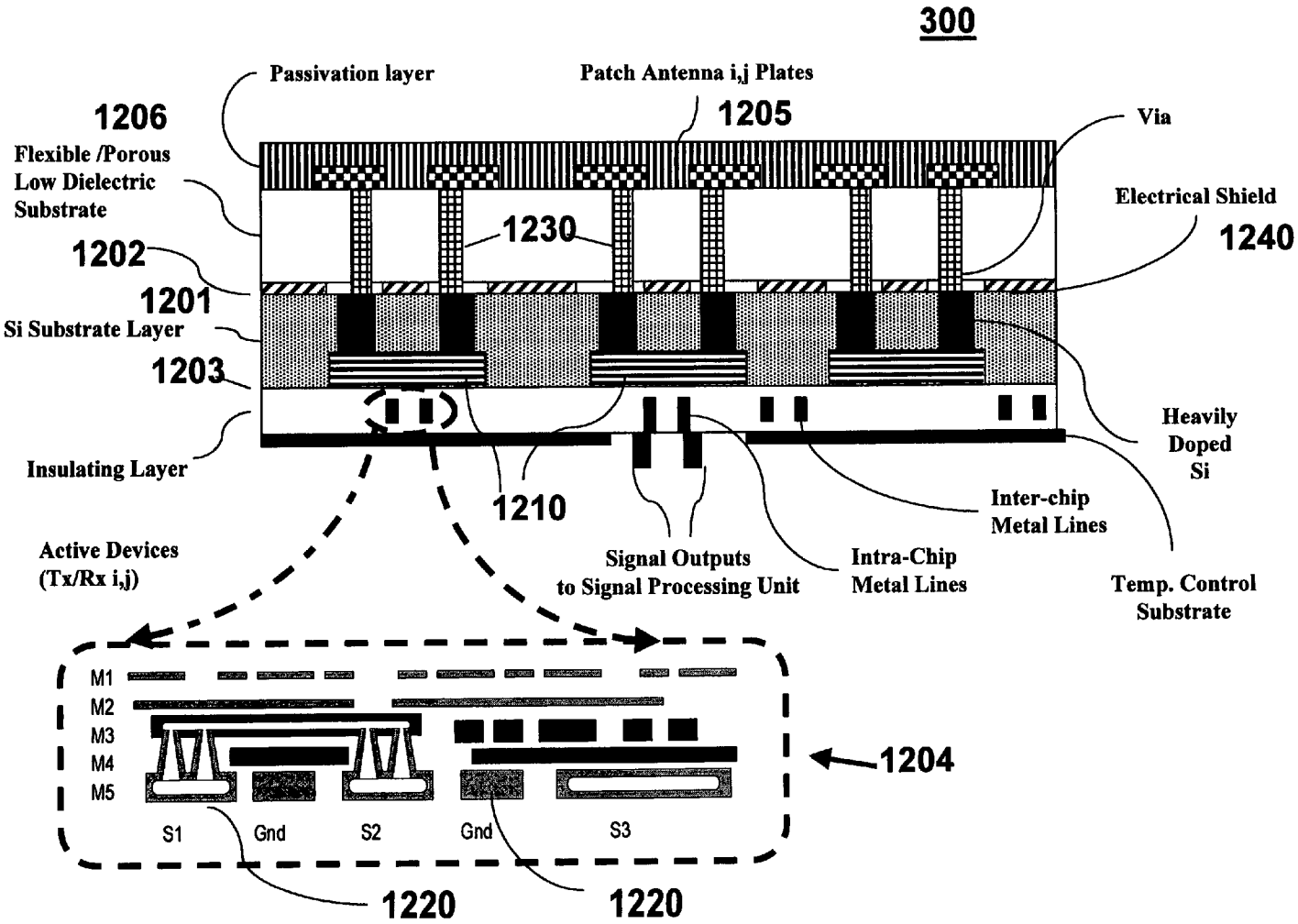
Fig. 12.a

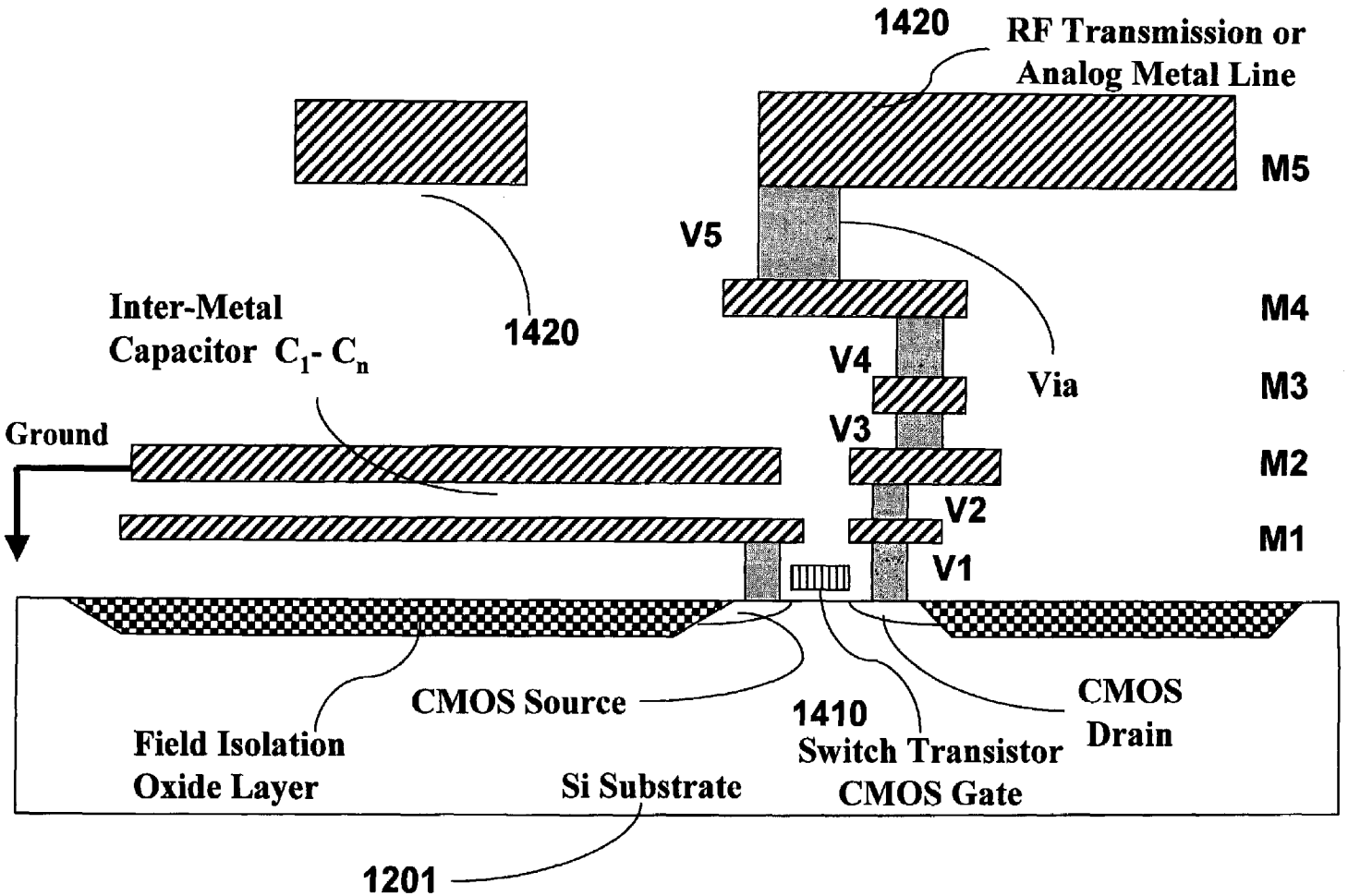
Fig. 12.b

1400

1500

1600

ULTRA-WIDEBAND PULSE SHAPING FOR WIRELESS COMMUNICATIONS

RELATED APPLICATIONS

This application is a continuation-in-part of U.S. application Ser. No. 11/182,344, filed Jul. 15, 2005, now U.S. Pat. No. 7,321,339, which in turn is a continuation-in-part of U.S. application Ser. No. 11/141,283, filed May 31, 2005, now U.S. Pat. No. 7,312,763, which in turn claims the benefit of U.S. Provisional Application No. 60/643,989, filed Jan. 14, 2005. In addition, this application claims the benefit of U.S. Provisional Application Nos. 60/693,555, filed Jun. 24, 2005, 60/721,164, filed Sep. 27, 2005, 60/754,250, filed Dec. 27, 2005, 60/721,204, filed Sep. 28, 2005, and 60/765,846, filed Feb. 7, 2006. The contents of the above-mentioned applications are hereby incorporated by reference in their entirety.

TECHNICAL FIELD

The present invention relates generally to wireless communication, and more particularly to a wafer-scale pulse-shaping device.

BACKGROUND

Ultra-wideband wireless communication has great promise in that high data rates may be achieved using a relatively low power transmitter. Ultra-wideband wireless communication may also be denoted as impulse radio because of its use of very short pulses (approximately 1 nanosecond or less). By varying individual pulse positions within a waveform of such pulses, high-data-rate information may be transmitted using very low average power such as in the milliwatt range.

Much interest has been generated for impulse radio because of its low power consumption, extremely high data rate, and excellent multipath immunity. By integrating impulse radio with beamforming capabilities, very low probability of detection performance may be achieved. In contrast to mechanically steered antennas, electronically-controlled beamforming systems are lighter, more agile, and more reliable. A key element of beamforming systems is the design of the phase shifter, which is conventionally implemented using a monolithic microwave integrated circuit (MMIC). However, MMICs are costly and introduce a relatively high insertion loss. As a result, Micro-Electro-Mechanical-Systems (MEMS)-based phase shifters have been developed. But MEMS-based phase shifters are not compatible with conventional semiconductor processes. Moreover, regardless of whether beamforming is provided, the generation of impulses has proven to be extremely difficult to master.

Accordingly, there is a need in the art for improved impulse radio generation and for the integration of such impulse radio generation with beamforming capabilities.

SUMMARY

In accordance with one aspect of the invention, an impulse radio is provided that includes: a signal source operable to provide a sinusoidal source signal; a pulse shaping circuit having a plurality of selectable delay paths, the pulse shaping circuit being configured to rectify and level shift the sinusoidal source signal through selected ones of the selectable delay paths to provide an impulse signal output; a substrate; a plurality of antennas adjacent to the substrate; an RF feed network adjacent to the substrate and coupled to the pulse shaping circuit, the RF feed network being configured to transmit the impulse signal output to the plurality of antennas, and a distributed plurality of amplifiers integrated with the substrate and operable to amplify the impulse signal output propagated through RF feed network.

In accordance with another aspect of the invention, an impulse signal transmitter is provided that includes: a substrate; a plurality of impulse signal generators integrated into the substrate, each impulse signal generator including a signal source operable to provide a sinusoidal source signal and a pulse shaping circuit having a plurality of selectable delay paths, the pulse shaping circuit being configured to rectify and level shift the sinusoidal source signal through selected ones of the selectable delay paths to provide an impulse signal output; and a plurality of antennas formed adjacent to the substrate corresponding to the plurality of signal generators, each impulse signal generator being operable to drive its antenna with it impulse signal output.

In accordance with another embodiment of the invention, a multiple-input multiple-output (MIMO) circuit is provided that includes: a wafer substrate; a transmission network adjacent to the substrate defining multiple channels; a VCO integrated with the substrate; a plurality of pulse-shaping circuits integrated with the substrate, each pulse-shaping circuit adapted to level-shift and delay versions of an output signal from the VCO to provide pulses, wherein each pulse-shaping circuit is adapted to drive a corresponding channel in the transmission network; and a plurality of antennas adjacent to the substrate, each antenna coupled to a corresponding channel in the transmission network.

The invention will be more fully understood upon consideration of the following detailed description, taken together with the accompanying drawings.

BRIEF DESCRIPTION OF THE DRAWINGS

FIG. 12*a* is a cross-sectional view of an integrated antenna circuit having a coplanar waveguide RF feed network in accordance with an embodiment of the invention.

FIG. 12*b* is a cross-sectional view of an integrated capacitor for a distributed phase shifter in the integrated antenna circuit of FIG. 12*a*.

DETAILED DESCRIPTION

Figure 1:
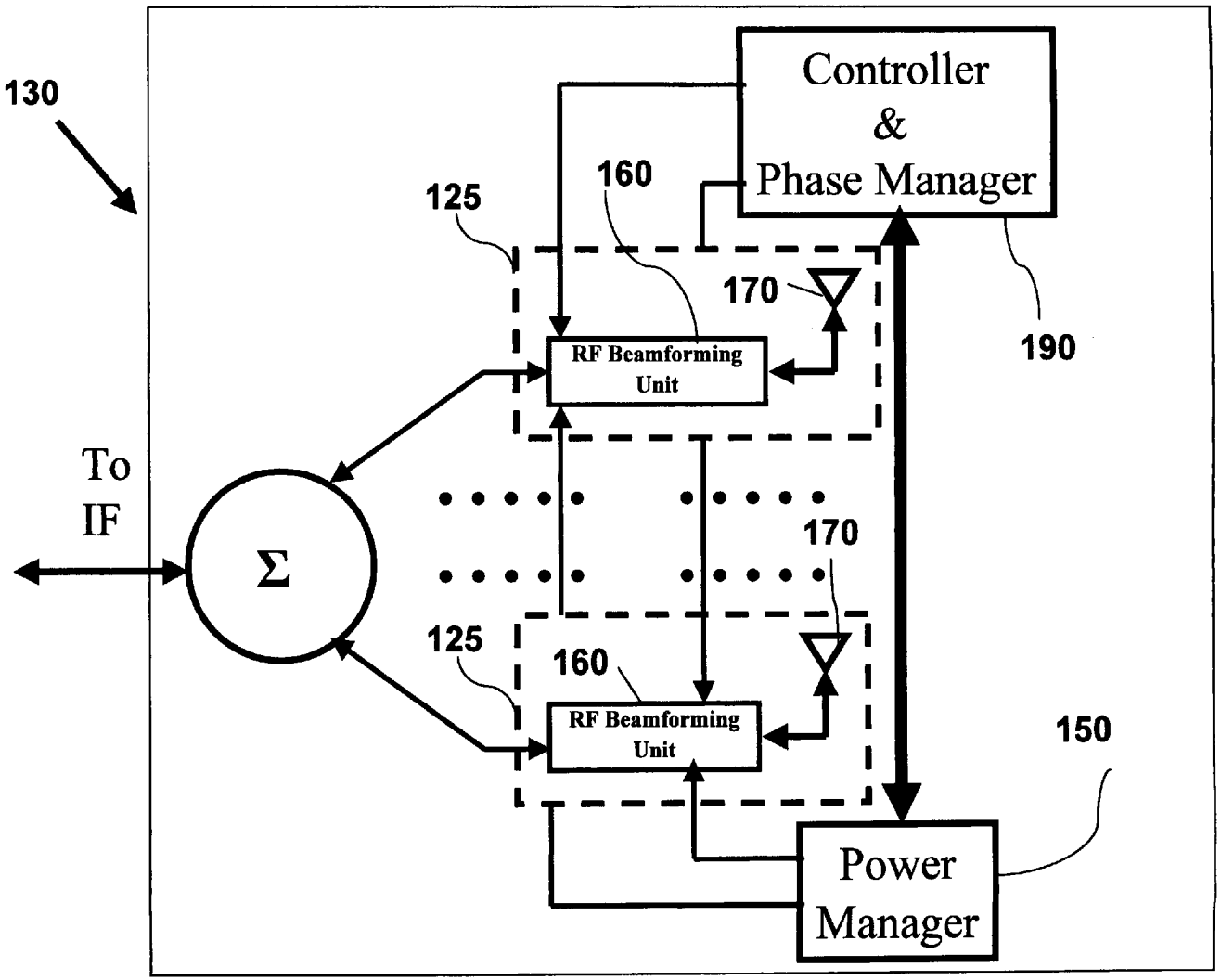
FIG. 1 is a block diagram of a beamforming antenna array in which the beamforming is performed in the RF domain.

Reference will now be made in detail to one or more embodiments of the invention. While the invention will be described with respect to these embodiments, it should be understood that the invention is not limited to any particular embodiment. On the contrary, the invention includes alternatives, modifications, and equivalents as may come within the spirit and scope of the appended claims. Furthermore, in the following description, numerous specific details are set forth to provide a thorough understanding of the invention. The invention may be practiced without some or all of these specific details. In other instances, well-known structures and principles of operation have not been described in detail to avoid obscuring the invention.

The impulse signal generation techniques discussed herein are compatible with the wafer scale antenna module distributed amplification and phase shifters disclosed in commonly-assigned U.S. application Ser. Nos. 11/141,283 and 11/182,344, the contents of which are incorporated by reference. An exemplary embodiment of the wafer scale beamforming approach disclosed in these applications may be better understood with regard to the beamforming system of FIG. 1, which illustrates an integrated RF beamforming and controller unit 130. In this embodiment, the receive and transmit antenna arrays are the same such that each antenna 170 functions to both transmit and receive. A plurality of integrated antenna circuits 125 each includes an RF beamforming interface circuit 160 and receive/transmit antenna 170. RF beamforming interface circuit 160 adjusts the phase and/or the amplitude of the received and transmitted RF signal responsive to control from a controller/phase manager circuit 190. Although illustrated having a one-to-one relationship between beamforming interface circuits 160 and antennas 170, it will be appreciated, however, that an integrated antenna circuit 125 may include a plurality of antennas all driven by RF beamforming interface circuit 160.

Figure 2:
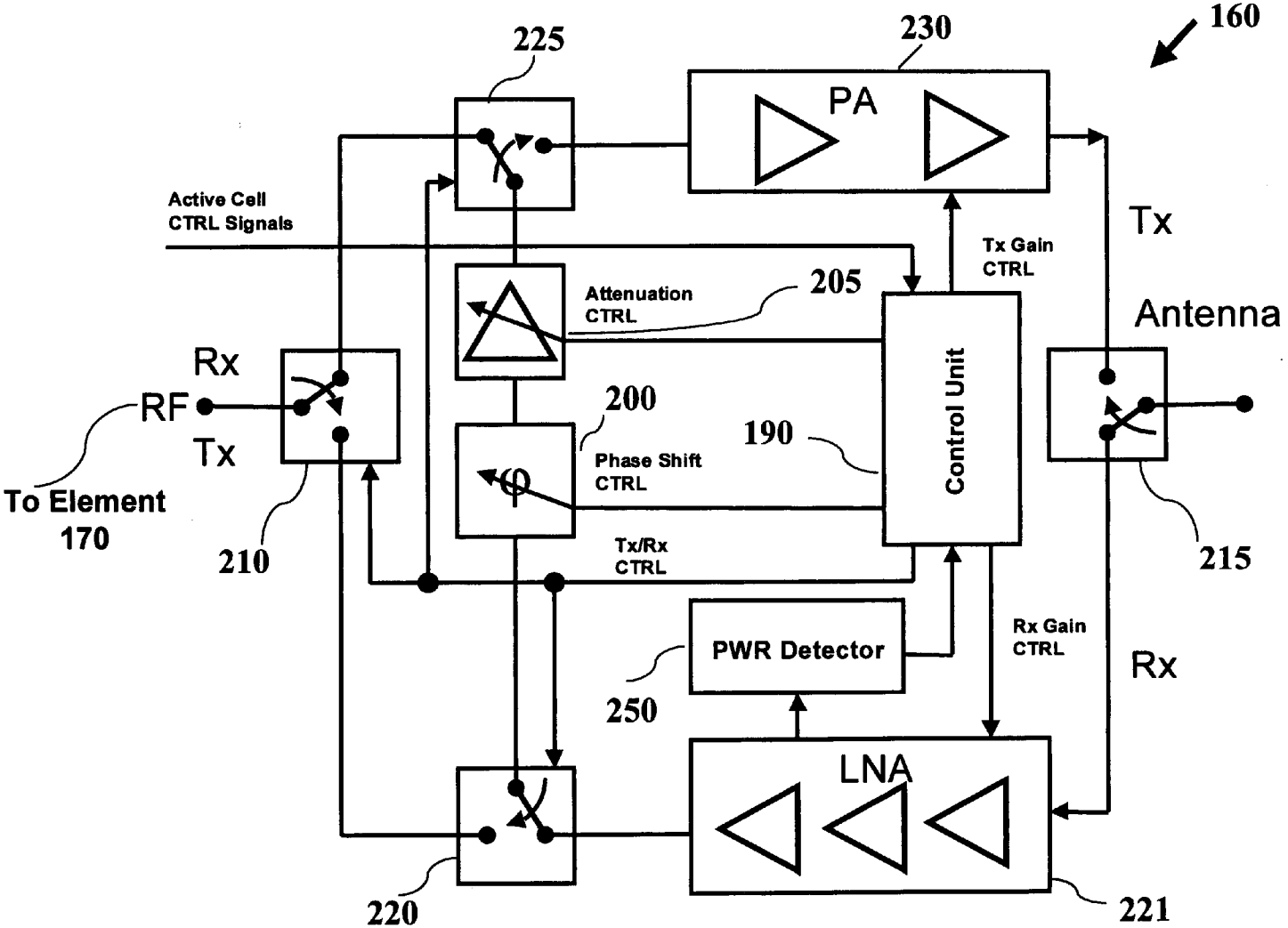
FIG. 2 is a schematic illustration of an RF beamforming interface circuit for the array of FIG. 1.

A circuit diagram for an exemplary embodiment of RF beamforming interface circuit 160 is shown in FIG. 2. Note that the beamforming performed by beamforming circuits 160 may be performed using either phase shifting, amplitude variation, or a combination of both phase shifting and amplitude variation. Accordingly, RF beamforming interface circuit 160 is shown including both a variable phase shifter 200 and a variable attenuator 205. It will be appreciated, however, that the inclusion of either phase shifter 200 or attenuator 205 will depend upon the type of beamforming being performed. To provide a compact design, RF beamforming circuit may include RF switches/multiplexers 210, 215, 220, and 225 so that phase shifter 200 and attenuator 205 may be used in either a receive or transmit configuration. For example, in a receive configuration RF switch 215 routes the received RF signal to a low noise amplifier 221. The resulting amplified signal is then routed by switch 220 to phase shifter 200 and/or attenuator 205. The phase shifting and/or attenuation provided by phase shifter 200 and attenuator 205 are under the control of controller/phase manager circuit 190. The resulting shifted signal routes through RF switch 225 to RF switch 210. RF switch 210 then routes the signal to IF processing circuitry (not illustrated).

In a transmit configuration, the RF signal received from IF processing circuitry (alternatively, a direct down-conversion architecture may be used to provide the RF signal) routes through RF switch 210 to RF switch 220, which in turn routes the RF signal to phase shifter 200 and/or attenuator 205. The resulting shifted signal is then routed through RF switch 225 to a power amplifier 230. The amplified RF signal then routes through RF switch 215 to antenna 170 (FIG. 1). It will be appreciated, however, that different configurations of switches may be implemented to provide this use of a single set of phase-shifter 200 and/or attenuator 205 in both the receive and transmit configuration. In addition, alternate embodiments of RF beamforming interface circuit 160 may be constructed not including switches 210, 220, and 225 such that the receive and transmit paths do not share phase shifter 200 and/or attenuator 205. In such embodiments, RF beamforming interface circuit 160 would include separate phase-shifters and/or attenuators for the receive and transmit paths.

To assist the beamforming capability, a power detector 250 functions as a received signal strength indicator to measure the power in the received RF signal. For example, power detector 250 may comprise a calibrated envelope detector. As seen in FIG. 1, a power manager 150 may detect the peak power determined by the various power detectors 250 within each integrated antenna circuit 125. The integrated antenna circuit 125 having the peak detected power may be denoted as the "master" integrated antenna circuit. Power manager 150 may then determine the relative delays for the envelopes for the RF signals from the remaining integrated antenna circuits 125 with respect to the envelope for the master integrated antenna circuit 125. To transmit in the same direction as this received RF signal, controller/phase manager 190 may determine the phases corresponding to these detected delays and command the transmitted phase shifts/attenuations accordingly. Alternatively, a desired receive or transmit beamforming direction may simply be commanded by controller/phase manager 190 rather than derived from a received signal. In such embodiment, power managers 150 and 250 need not be included since phasing information will not be derived from a received RF signal.

Regardless of whether integrated antenna circuits 125 perform their beamforming using phase shifting and/or amplitude variation, the shifting and/or variation is performed on the RF signal received either from the IF stage (in a transmit mode) or from its antenna 170 (in a receive mode). By performing the beamforming directly in the RF domain as discussed with respect to FIGS. 1 and 2, substantial savings are introduced over a system that performs its beamforming in the IF or baseband domain. Such IF or baseband systems must include A/D converters for each RF channel being processed. In contrast, the system shown in FIG. 1 may supply a combined RF signal from an adder 140. From an IF standpoint, it is just processing a single RF channel for the system of FIG. 1, thereby requiring just a single A/D. Accordingly, the following discussion will assume that the beamforming is performed in the RF domain. The injection of phase and/or attenuation control signals by controller/phase manager circuit 190 into each integrated antenna circuit 125 may be performed inductively as discussed in commonly-assigned U.S. Pat. No. 6,885,344.

Figure 3:
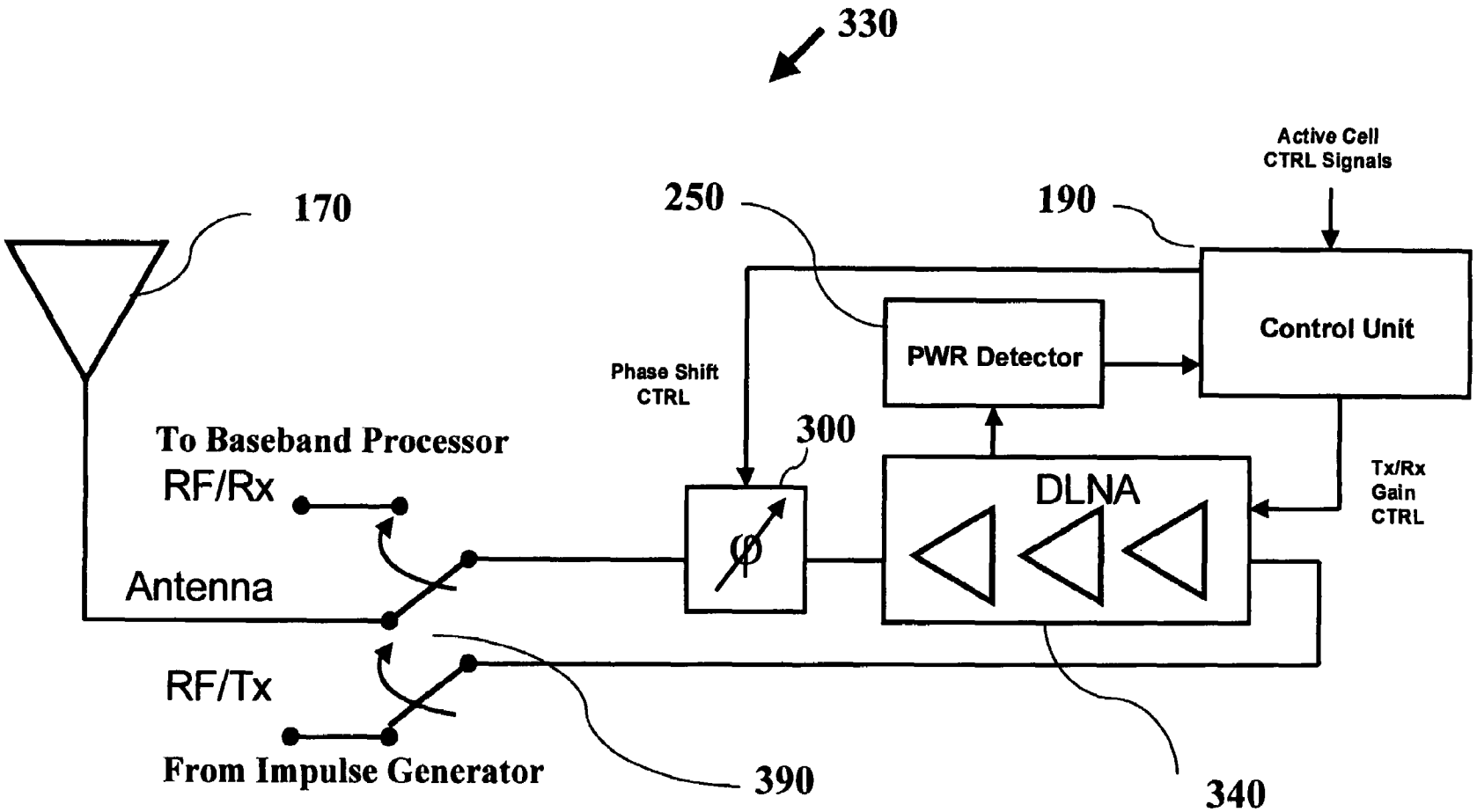
FIG. 3 is a high-level schematic illustration of an RF beamforming interface circuit including a distributed phase shifter and a distributed amplifier in accordance with an embodiment of the invention.

Referring now to FIG. 3, another exemplary embodiment of an RF beamforming interface circuit 160 is illustrated. In this embodiment, signals are distributed between the baseband processor/impulse generator and the antennas using a coplanar waveguide network 330, which may be either full-duplex or half-duplex. In the embodiment illustrated in FIG. 3, CPW network 330 is half-duplex. However, it will be appreciated that the full-duplex arrangement may also be used. To accommodate half-duplex transmission, RF switches 390 select for either a receiving or transmitting mode. In the transmitting mode, an RF impulse generator discussed further herein provides an RF signal to distributed low noise amplifier (DLNA) 340. In turn, DLNA 340 provides its amplified signal to distributed phase shifter 300 so that the amplified signal may be phase shifted according to commands from control unit 190. In the receiving mode, RF switches 390 are configured so that a received RF signal from antenna 170 couples through DLNA 340 and phase shifter 300 to a baseband processor. As discussed earlier, a power detector 250 may be used to determine the "master" antenna based upon received power for beam steering purposes. The implementations of phase shifter 200 and DLNA 340 will be discussed further in greater detail.

Figure 4:
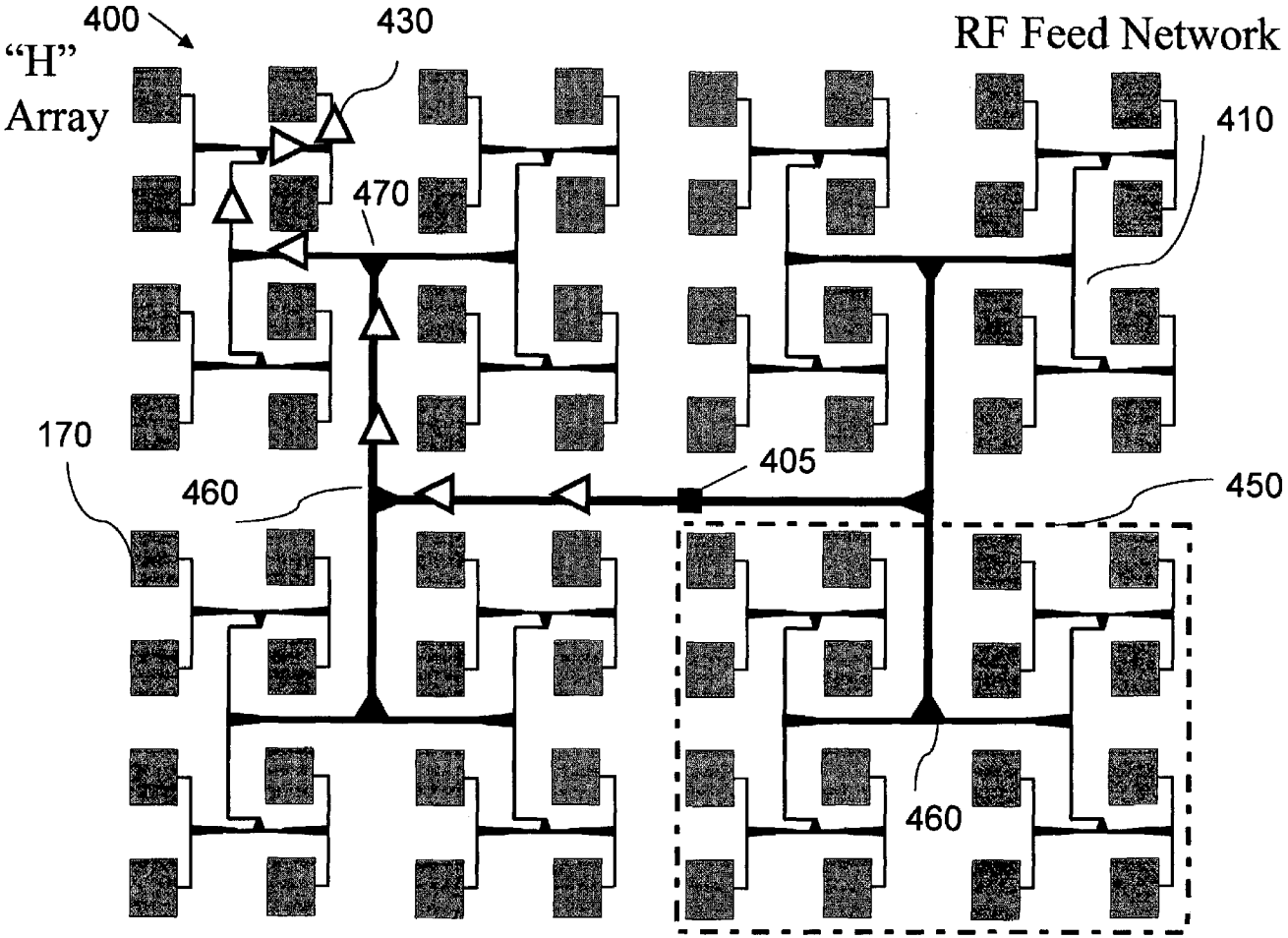
FIG. 4 is a plan view of a wafer scale beamforming antenna array module and its associated transmission network in accordance with an embodiment of the invention.
Figure 5:
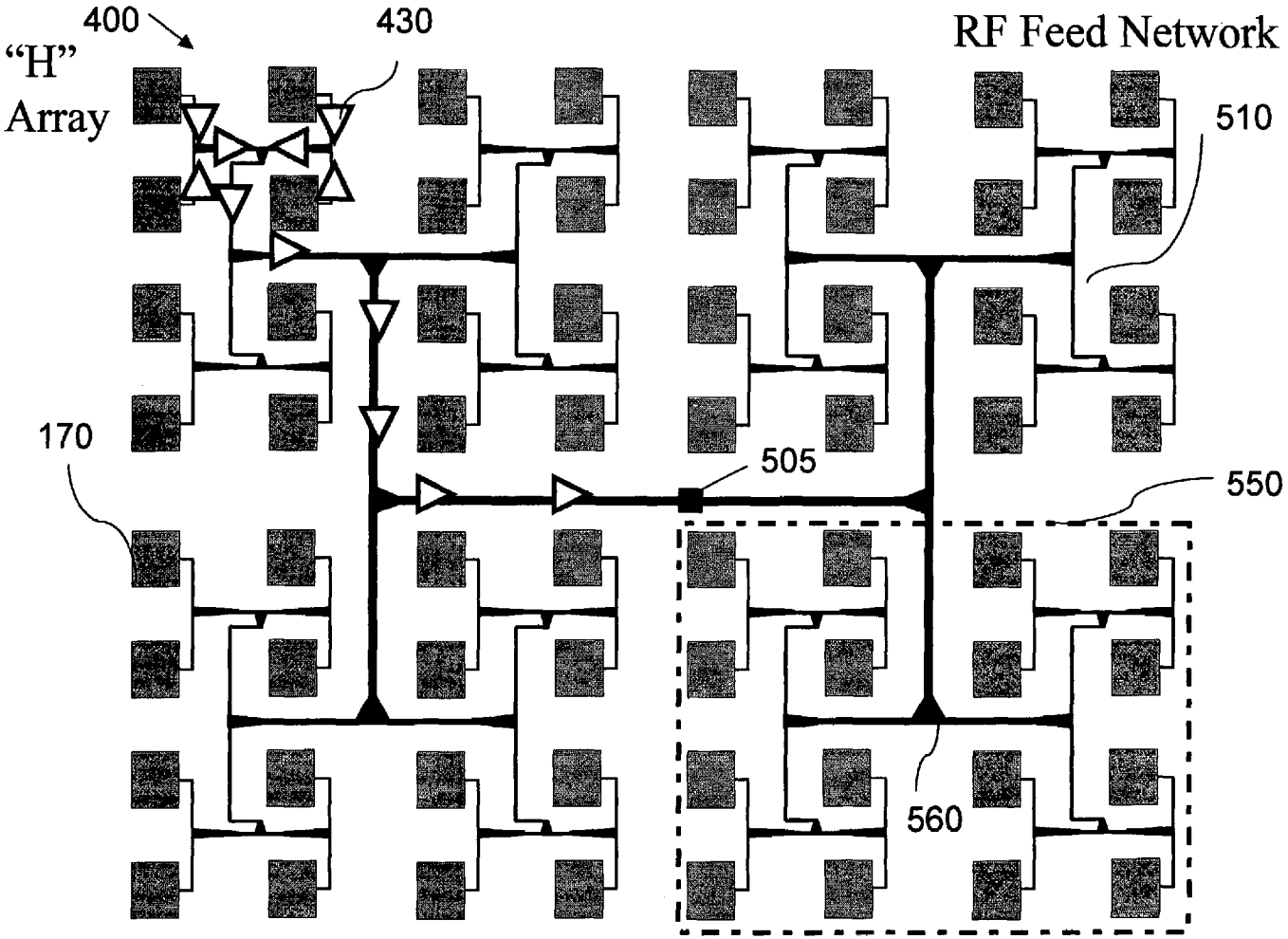
FIG. 5 is a plan view of a wafer scale beamforming antenna array module and its associated receiving network in accordance with an embodiment of the invention.

The CPW network and antennas may advantageously be implemented in a wafer scale antenna module. A view of an 8" wafer scale antenna module 400 having 64 antenna elements 170 is illustrated in FIGS. 4 and 5. A half-duplex transmission network 410 is illustrated in FIG. 4. From a center feed point 405, transmission network 410 couples to every antenna element 170. For such an array, the transmission distance from feed point 405 to any given antenna element may be approximately 120 mm, which is close to four wavelengths at 10 GHz. Should network 410 be implemented using CPW, the transmission losses can thus exceed 120 dB. Although the scope of the invention includes the use of any suitable architecture for network 410 such as CPW, microstrip, and planar waveguide, CPW enjoys superior shielding properties over microstrip. Thus, the following discussion will assume without loss of generality that network 410 is implemented using CPW. A half-duplex receiving CPW network 510 for wafer scale antenna module 400 having 64 antenna elements 170 is illustrated in FIG. 5.

The transmission network may be single-ended or differential. In one embodiment, the network may comprise a coplanar waveguide (CPW) having a conductor width of a few microns (e.g., 4 microns). With such a small width or pitch to the network, a first array of 64 antenna elements and a second array of 1024 antenna elements may be readily networked in an 8 inch wafer substrate for 10 GHz and 40 GHz operation, respectively. The distributed low noise amplifiers will be described first, followed by a discussion of the distributed (or discrete) phase shifters.

Figure 6:
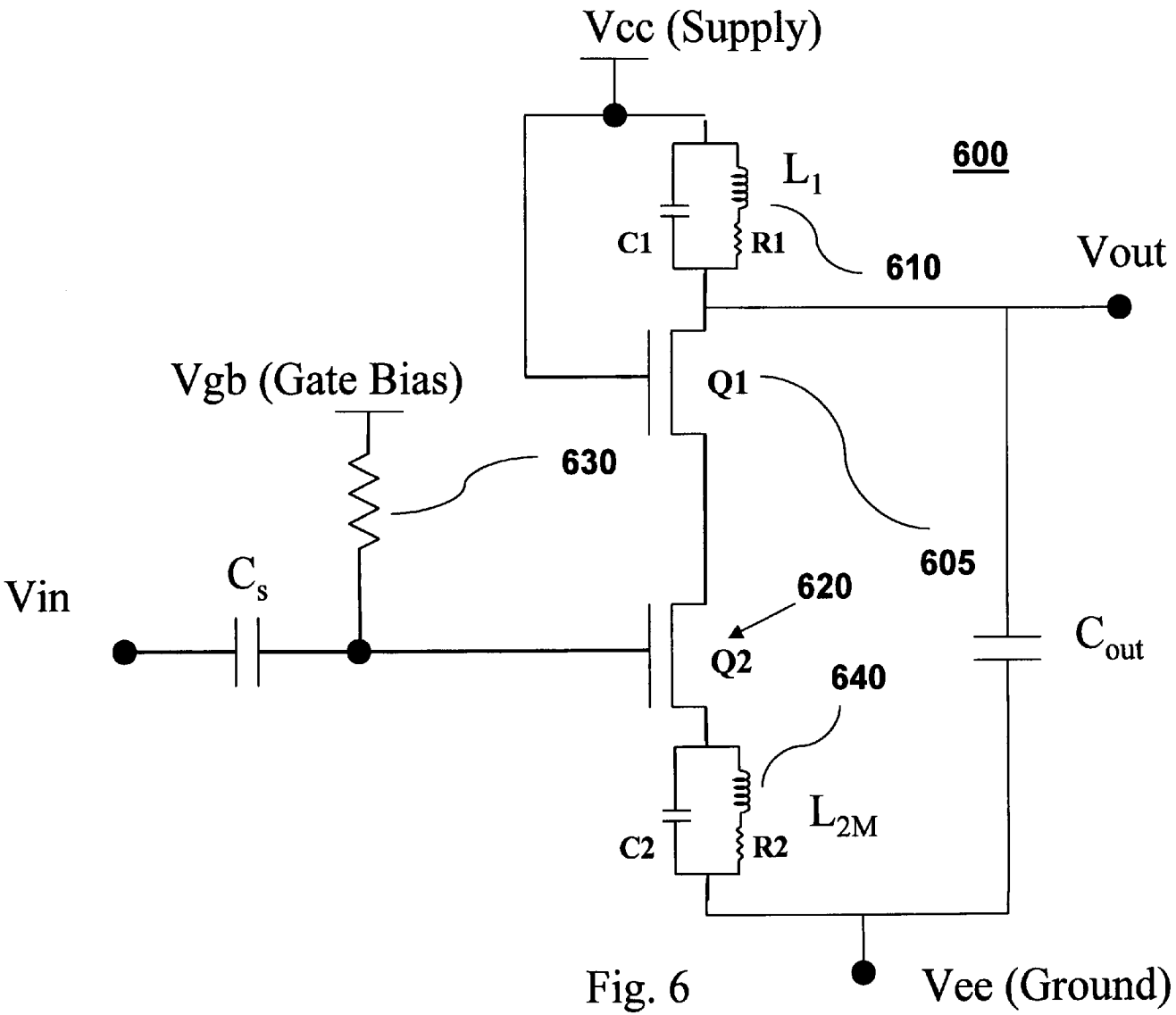
FIG. 6 is a schematic illustration of a matching amplifier in accordance with an embodiment of the invention.

In one embodiment, a driving amplifier in the network is followed by a matching amplifier for efficient performance. An exemplary embodiment of a FET-based matching amplifier 600 is illustrated in FIG. 6. Matching amplifier 600 couples to a coplanar waveguide network (not illustrated) at input port Vin and output port Vout. An analogous BJT-based architecture may also be implemented. The FETs may be either NMOS or PMOS. A first NMOS FET Q1 605 has its drain coupled through an integrated inductor (L1) 610 to a supply voltage Vcc. This integrated inductor L1 may be formed using metal layers in a semiconductor process as discussed in commonly-assigned U.S. Pat. No. 6,963,307. Because such an integrated inductor L1 will also have a stray capacitance and resistance, these stray effects are modeled by capacitor C1 and resistor R1. The metal layers in the semiconductor process may also be used to form a DC blocking capacitor $C_s$ and an output capacitor $C_{out}$. The supply voltage also biases the gate of Q1. Q1 has its drain driving Vout and its drain coupled to a second NMOS FET Q2 620. A voltage source 630 coupled through a high value resistor or configured transistor (not illustrated) biases the gate of Q2 620 with a voltage Vgb. The source of Q2 620 couples to ground through an inductor (L2) 640. Analogous to inductor 610, inductor 640 has its stray capacitance and resistance modeled by capacitor C2 and resistor R2. It may be shown that an input resistance Rin for amplifier 600 is as follows:

$$Rin=(gm)*L2/Cgs$$

where gm is the transconductance for Q2 620, L2 is the inductance of the inductor 640 and Cgs is the gate-source capacitance for Q2 620. Thus, Q2 620 and inductor 640 characterize the input impedance and may be readily designed to present a desired impedance. For example, if an input resistance of 50Ω is desired (to match a corresponding impedance of the CPW network), the channel dimensions for Q2 and dimensions for inductor 640 may be designed accordingly.

Figure 7A:
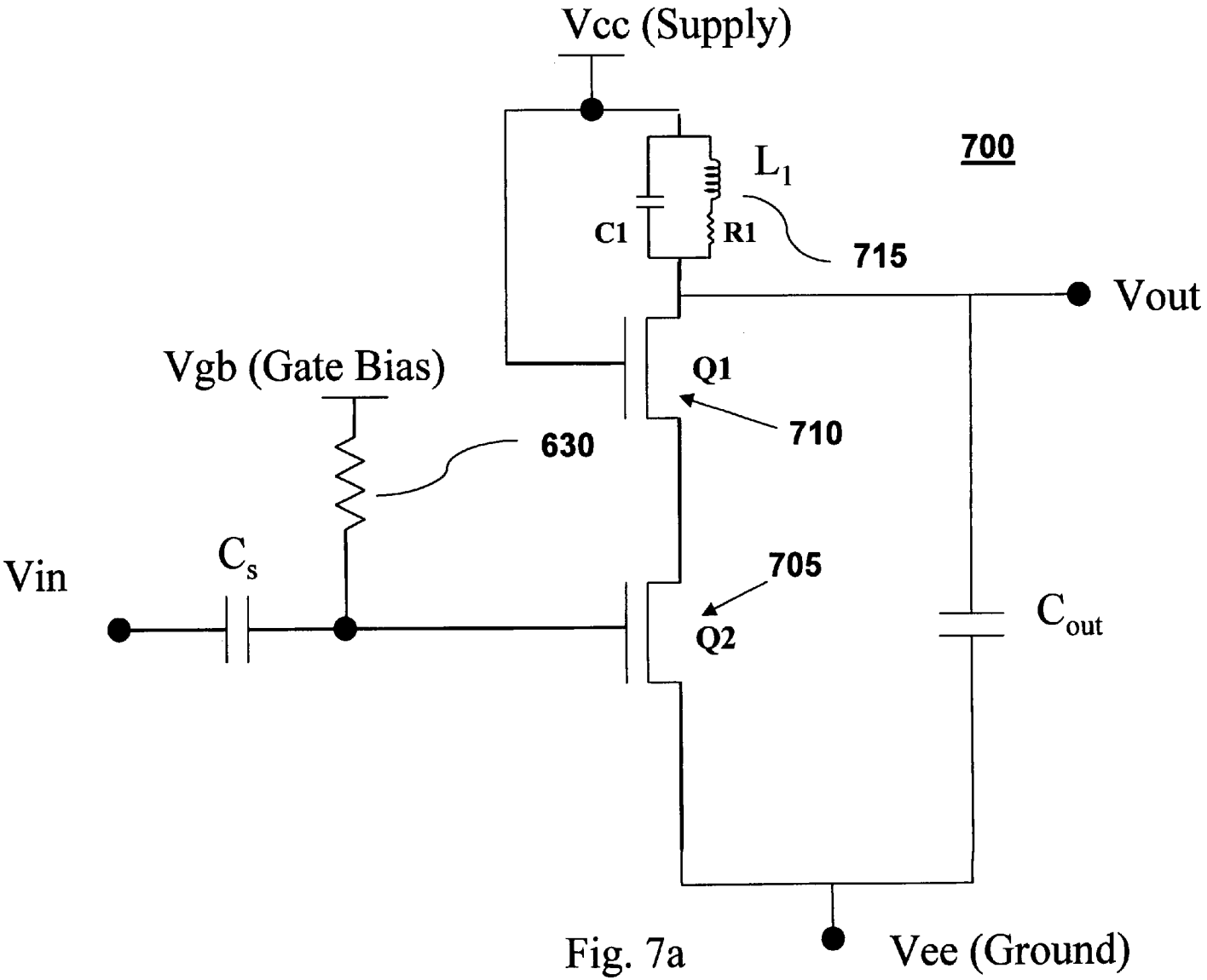
FIG. 7*a* is a schematic illustration of a driving amplifier for distributed amplification in accordance with an embodiment of the invention.

An exemplary driving amplifier 700 is illustrated in FIG. 7*a*. Driving amplifier 700 is constructed analogously to matching amplifier 600 except that no inductor loads the source of Q2 705. A transistor Q1 710 has its drain loaded with an integrated inductor 715 in a similar fashion as discussed with regard to Q1 605 of matching amplifier 600. Inductor 715 determines a center frequency Fd for driving amplifier 700 whereas both inductors 640 and 610 establish a resonant frequency Fm for matching amplifier 600. It may be shown that the band-pass center frequency Fc of a series-connected driving and matching amplifier is given as $$Fc=\tfrac{1}{2}*sqrt(Fd^2+Fm^2)$$

Referring back to FIG. 4, a series of driving amplifier/matching amplifier pairs 430 are shown coupling feed point 405 to a first network intersection 460. In such an "H" configured network array, network 410 will continue to branch from intersection 460 such as at an intersection 470. For a half-duplex embodiment, driving amplifier/matching amplifier pairs 430 may also be incorporated in receiving network 510 as seen in FIG. 5. For illustration clarity, the distribution of the driving amplifier/matching amplifier pairs 430 is shown only in selected transmission paths in FIGS. 4 and 5. It will be appreciated that both the driving amplifiers and the matching amplifiers may be constructed using alternative arrangements of bipolar transistors such as PNP bipolar transistors or NPN bipolar transistors. Moreover, the RF feed network and these amplifiers may be constructed in either a single ended or differential fashion. DC and control lines may be arranged orthogonally to the RF distribution direction for isolation. In addition, this same orthogonality may be maintained for the RF transmit and receive networks in a full duplex design.

Figure 8:
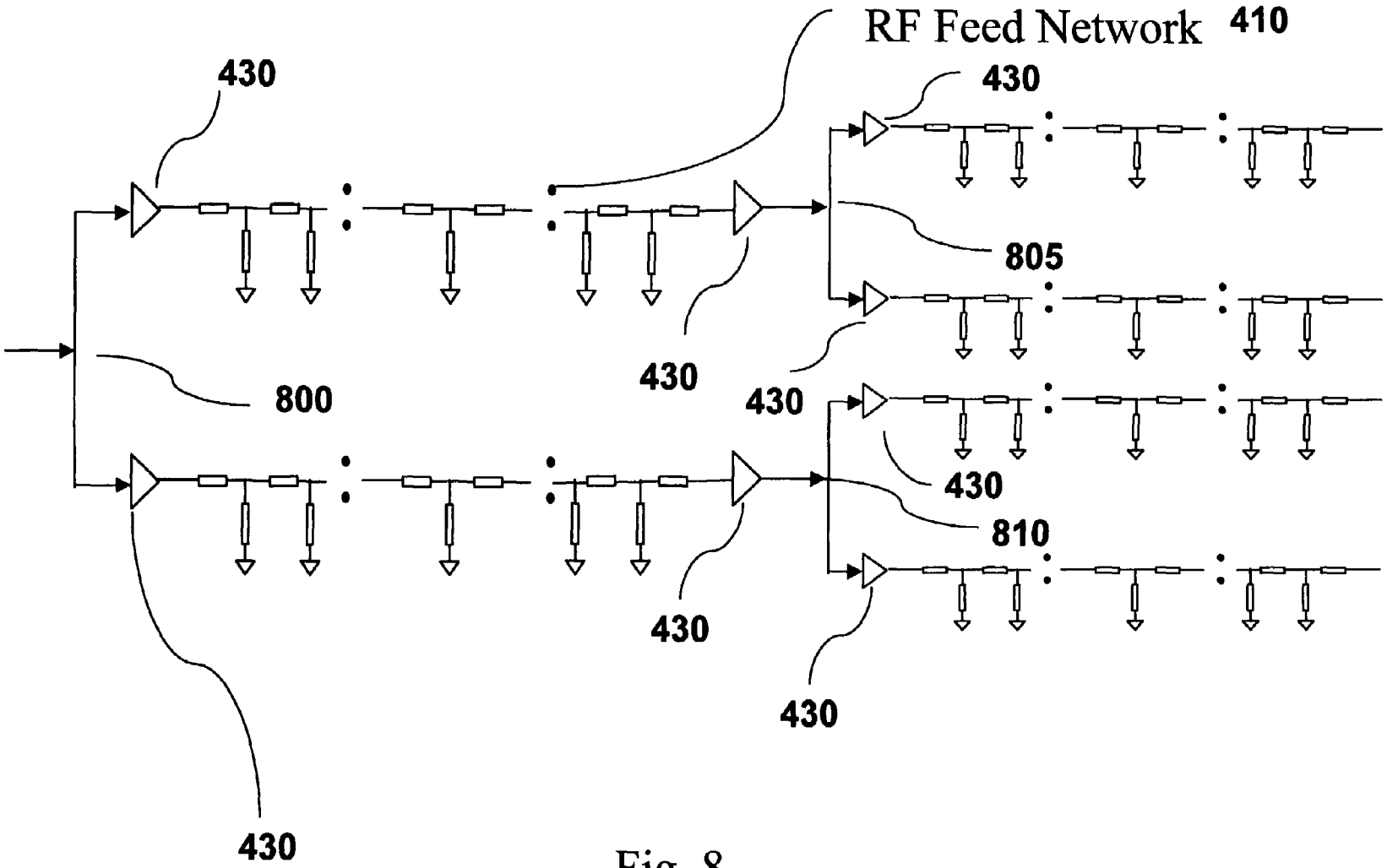
FIG. 8 illustrates a distributed amplification arrangement with respect to a splitting junction in accordance with an embodiment of the invention.

Turning now to FIG. 8, a single driving amplifier/matching amplifier pair 430 may both precede and follow network branching intersections 800, 805, and 810 in transmission network 410. Alternatively, just a single pair 430 may drive each branching intersection. It will be appreciated that the same considerations apply to a receiving (and hence combining) network. Indeed, the same network may be used for both transmission and reception in a half-duplex design. In a full duplex, separate transmit and receive RF feed networks should be used to avoid interference.

Figure 9:
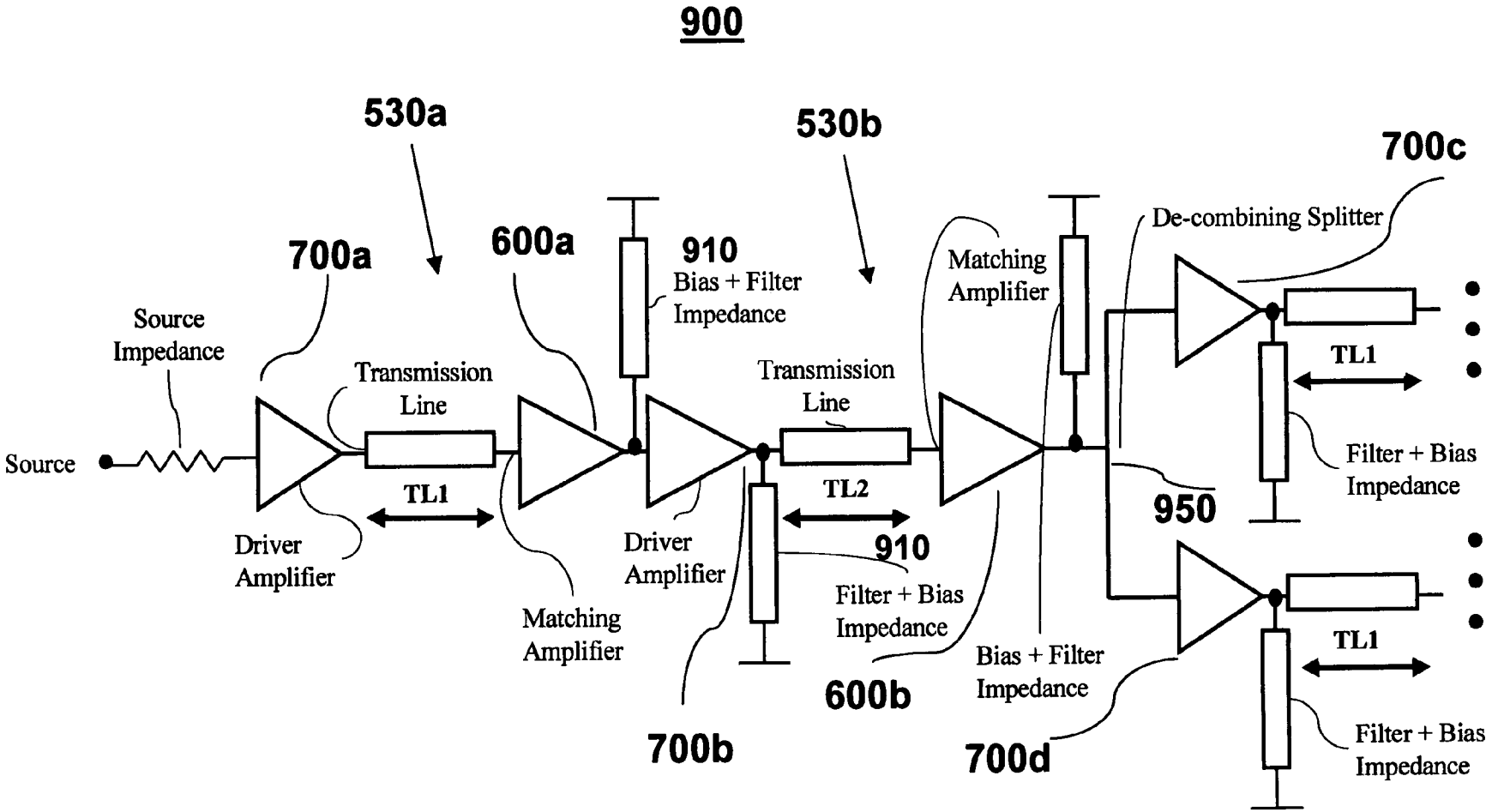
FIG. 9 illustrates a distributed amplification arrangement with respect to a splitting junction in accordance with an embodiment of the invention.

Network properties are influenced by the distance between driving amplifiers and matching amplifiers in successive driving amplifier/matching amplifier pairs. For example, as seen for RF network portion 900 in FIG. 9, its input or source is received at a first driver amplifier 700*a*, which drives a matching amplifier 600*a* separated from driver 700*a* by a length of network transmission line (such as coplanar waveguide) of length TL1. Driver amplifier 700*a* and matching amplifier 600*a* thus constitute a first driving amplifier/matching amplifier pair 530*a*, which may also be denoted as a load balanced amplifier (LBA). Matching amplifier 600*a* is immediately followed by a driver amplifier 700*b*, which couples to the output of matching amplifier 600*a* directly in the active circuitry silicon rather than through a transmission line section. In this fashion, die space on the wafer substrate is conserved. However, it will be appreciated that an RF network CPW transmission line segment could also be used to couple matching amplifier 600*a* to driving amplifier 700*b*. Driver amplifier 700*b* drives a matching amplifier 600*b* separated from driver 700*b* by a length TL2 of network transmission line. Driver amplifier 700*b* and matching amplifier 600*b* thus form a second driving amplifier/matching amplifier 530*b*. The necessary biasing and inductance loading as described with respect to FIGS. 6 and 7*a* are represented by bias and filter impedances 910. In general, the sum of TL1 and TL2 should equal one half of the center frequency wavelength. By changing the ratio of TL1/TL2 and the output capacitance, a maximum stable gain of approximately 20 to 30 dB may be obtained for 10 GHz to, for example, 40 GHz operation. In a 10 GHz embodiment, stable gain and frequency performance may be realized for a capacitance load of 50 fF as TL1/TL2 is varied from 40% to 80%.

In prior art RF.distribution networks splitting and combining signals was problematic and involved cumbersome combiner or splitter circuitry. However, note the simplicity involved for the coupling of matching amplifier 600*b* through a splitting junction 950 to driver amplifiers 700*c* and 700*d*. This coupling occurs through a node in the active circuitry substrate to conserve wafer substrate area. However, this substrate coupling may be replaced by a CPW transmission line segment in alternative embodiments. As compared to prior art splitters, not only is there no loss coupling through splitting junction 950, but there is a gain instead. Moreover, transmission through the RF feed network is low loss and low noise because the driver and matching amplifiers are tuned with reactive components only—no resistive tuning (and hence loss) need be implemented.

Figure 10:
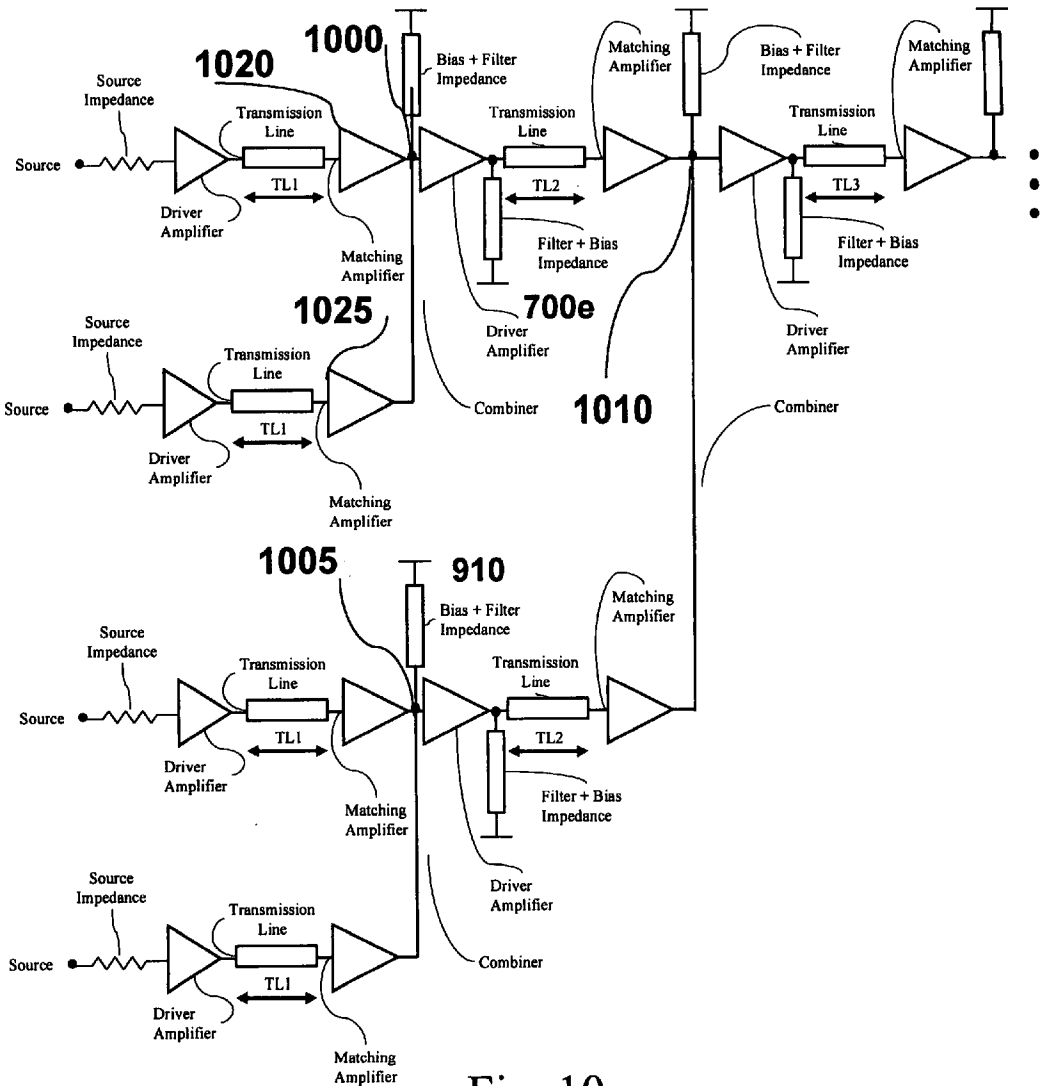
FIG. 10 illustrates a distributed amplification arrangement with respect to a combining junction in accordance with an embodiment of the invention.

The same low loss and simplicity of design advantages are present with respect to combining junction 1000, 1005, and 1010 as seen in FIG. 10. For example, with respect to junction 1000, two combiner matching amplifiers 1020 and 1025 (discussed further with regard to FIG. 11*a*) couple through a node in the active circuitry substrate to a driving amplifier 700*e* to conserve wafer substrate area. However, it will be appreciated that a CPW transmission line segment may be used to perform this coupling in alternative embodiments. Bias and filter impedance 910 is thus shared by both combiner matching amplifiers.

Figure 11A:
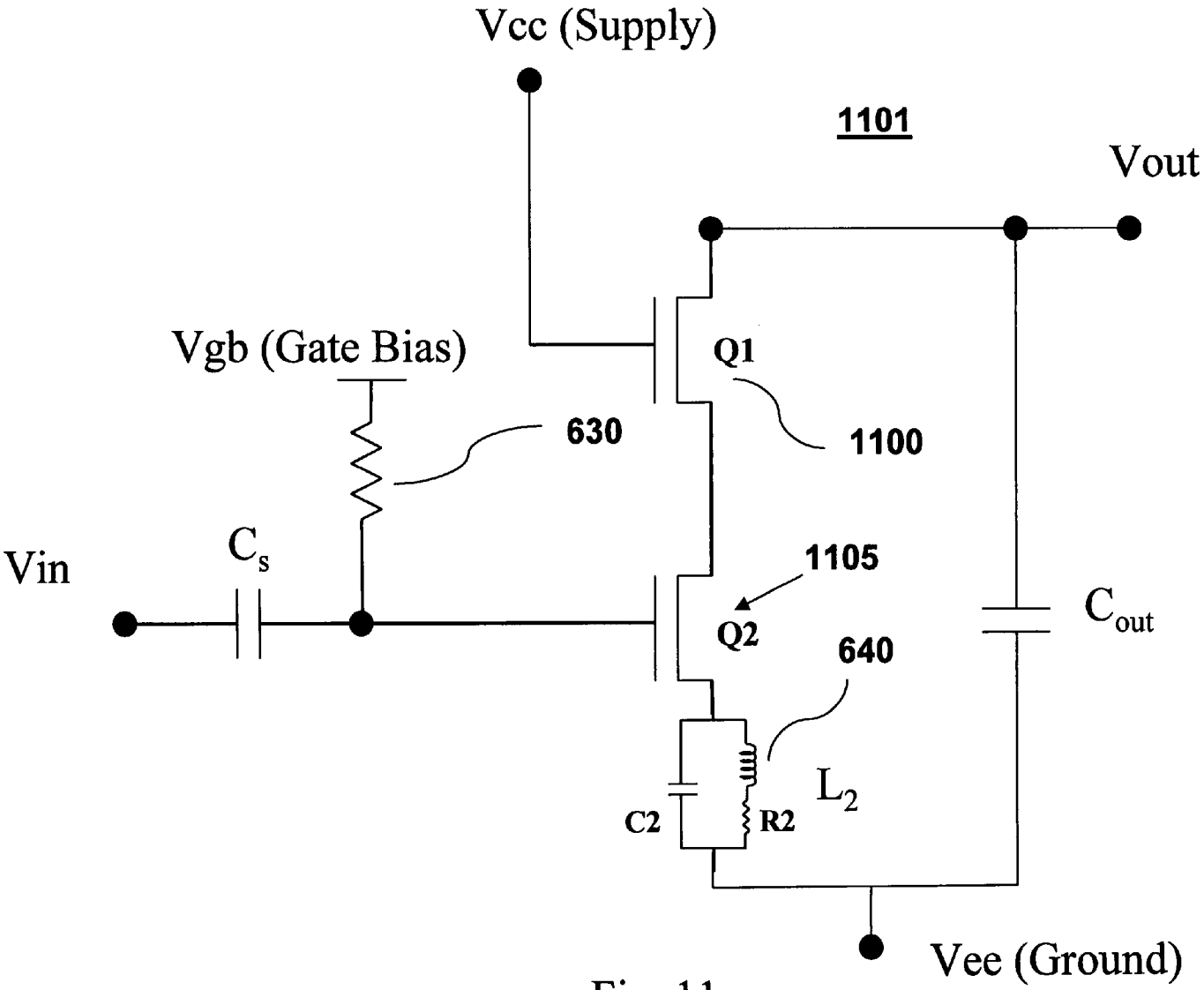
FIG. 11*a* is a schematic illustration of a matching amplifier for a combining junction used in distributed amplification in accordance with an embodiment of the invention.

Turning now to FIG. 11*a*, a combiner matching amplifier 1101 is distinguished from a non-combiner matching amplifier such as discussed with respect to FIG. 6 by the absence of L1 at the drain of a FET Q1 1100. A FET Q2 1105 has its drain loaded by the matching inductor 640 for impedance matching as discussed with respect to FIG. 6. A common load inductor (not illustrated) couples to output node Vout to uniformly load all the involved combiner matching amplifiers.

The integration of the CPW network and the distributed amplification into a wafer scale integrated antenna module (WSAM) may be better understood by classifying the WSAM into three layers. The first layer would be a semiconductor substrate, such as Si. On a first surface of the substrate, antennas such as patches for the integrated antenna circuits are formed as discussed, for example, in U.S. Pat. No. 6,870,503, the contents of which are incorporated by reference herein. Active circuitry for the corresponding integrated antenna circuits that drive these antennas are formed on a second opposing surface of the substrate. The CPW transmission network is formed adjacent this second opposing surface. The second layer would include the antennas on the first side of the substrate whereas the third layer would include the CPW network. Thus, such a WSAM includes the "back side" feature disclosed in U.S. Ser. No. 10/942,383 in that the active circuitry and the antennas are separated on either side of the substrate. In this fashion, electrical isolation between the active circuitry and the antenna elements is enhanced. Moreover, the ability to couple signals to and from the active circuitry is also enhanced. As discussed in U.S. Ser. No. 10/942,383, a heavily doped deep conductive junction through the substrate couples the active circuitry to vias/rods at the first substrate surface that in turn couple to the antenna elements. Formation of the junctions is similar to a deep diffusion junction process used for the manufacturing of double diffused CMOS (DMOS) or high voltage devices. It provides a region of low resistive signal path to minimize insertion loss to the antenna elements.

Upon formation of the junctions in the substrate, the active circuitry may be formed using standard semiconductor processes. The active circuitry may then be passivated by applying a low temperature deposited porous SiOx and a thin layer of nitridized oxide ($Si_xO_yN_z$) as a final layer of passivation. The thickness of these sealing layers may range from a fraction of a micron to a few microns. The opposing second surface may then be coated with a thermally conductive material and taped to a plastic adhesive holder to flip the substrate to expose the first surface. The substrate may then be back ground to reduce its thickness to a few hundreds of micrometers.

An electric shield may then be sputtered or alternatively coated using conductive paints on background surface. A shield layer over the electric field may form a reflective plane for directivity and also shields the antenna elements. In addition, parts of the shield form ohmic contacts to the junctions. For example, metallic lumps may be deposited on the junctions. These lumps ease penetration of the via/rods to form ohmic contacts with the active circuitry.

In an alternative embodiment, the CPW network may be integrated on the antenna side of the substrate. Because the backside approach has the isolation and coupling advantages described previously, the following discussion will assume without loss of generality that the RF feed network is integrated with the substrate in a backside embodiment. For example as seen in cross-section in FIG. 12*a*, a semiconductor substrate 1201 has opposing surfaces 1202 and 1203. Antenna elements 1205 such as patches are formed on a dielectric layer 1206 adjacent to surface 1202. Active circuitry 1210 integrated with substrate 301 includes the driving and matching amplifiers for an RF feed network 1204 having CPW conductors S1 and S2. Adjacent surface 303, metal layer M1 includes inter-chip and other signal lines. Metal layer M2 forms, among other things, a ground plane for CPW conductors S1 and S2, which are formed in metal layer 5 as well as ground plates 1220. Metal layer M4 provides a connecting layer to couple CPW conductors together as necessary. The driving and matching amplifiers within active circuitry 1210 couple through vias (not illustrated) in apertures in the ground plane in metal layer M2 to CPW conductors S1 and S2. This active circuitry may also drive antennas 1205 through a plurality of vias 1230 that extend through the dielectric layer. An electric shield layer 1240 isolates the dielectric layer from surface 1202 of the substrate. The antennas may be protected from the elements and matched to free space through a passivation layer.

Figure 13:
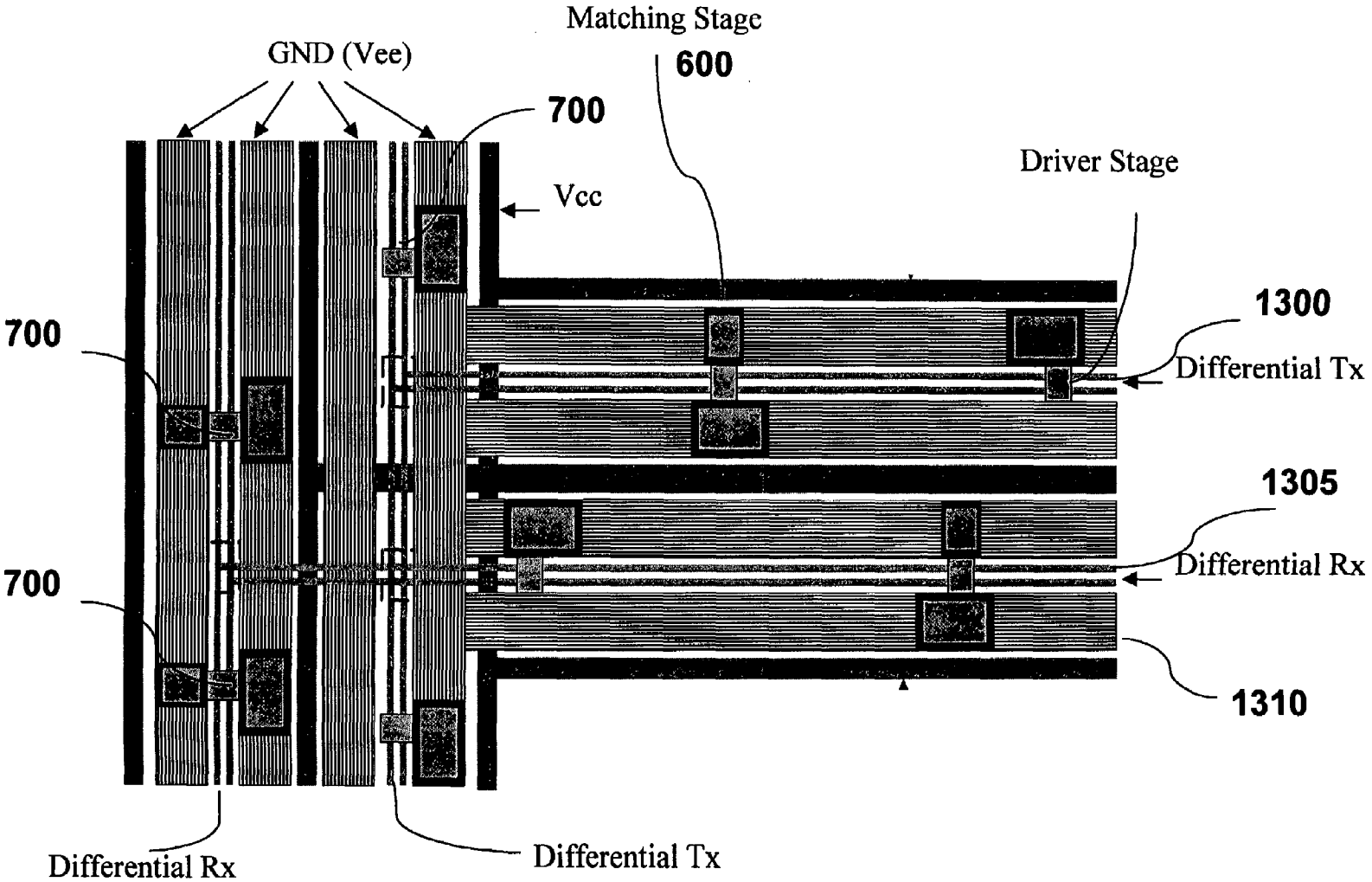
FIG. 13 is a plan view of a portion of the coplanar waveguide RF feed network of FIG. 12*a*.

A layout view for a section of RF feed network with respect towards surface 1203 of the substrate shown is illustrated in FIG. 13. In this embodiment, the RF feed network is differential having separate differential transmission coplanar waveguides 1300 and differential receiving coplanar waveguides 1305. For enhanced process quality, the corresponding ground plates 1310 for the waveguides are formed from separate conductive lines rather than solid plates. Driver amplifiers 700 and matching amplifiers 600 are integrated into the substrate (not illustrated) and couple through vias (not illustrated) to the ground plate and the waveguides.

Just as active circuitry is distributed across the CPW network for amplification (using, e.g., the matching and driving amplifiers discussed previously), active circuitry may also be used to form distributed phase shifters as will be explained further herein. The location of the distributed phase shifters depends upon the granularity desired for the beam steering capability. For example, referring back to FIGS. 4 and 5, each antenna element 170 could receive individual phase shifting through an adjacent and corresponding distributed phase shifter. To save costs and reduce power consumption, subsets of antenna elements 170 may share in the phase shifting provided by a corresponding distributed phase shifter. For example, consider a subset 450 or 550 having sixteen antenna elements 170. As seen in FIG. 4, a distributed phase shifter located adjacent an intersection 460 of network 410 would provide equal phase shifting for each of the elements within subset 450. Similar subsets would have their own distributed phase shifter. Similarly, as seen in FIG. 5, a distributed phase shifter located adjacent an intersection 560 of network 510 would provide equal phase shifting for each of the elements within subset 550 with respected a received RF signal. Thus, it may be appreciated that the granularity of the beam steering capability is a design choice and depends upon desired manufacturing costs and associated complexity.

Figure 14:
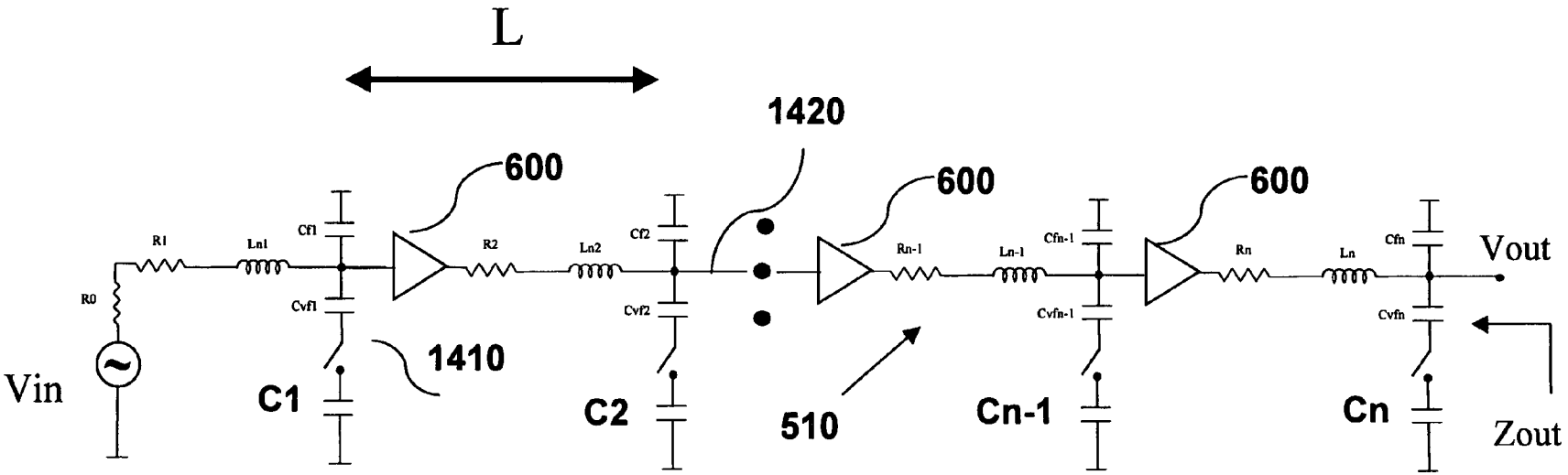
FIG. 14 is a schematic illustration of a distributed amplifier phase shifter in accordance with an embodiment of the invention.

Several embodiments may be used for a distributed phase shifter. For example, as seen in FIG. 14, a distributed amplifier phase shifter 1400 may be implemented using a set of n stages of matching amplifiers 600 and corresponding integrated capacitors C1 though Cn that may be selected through accompanying transistor switches 1410 to load a network such as the CPW network discussed with regard to FIGS. 4 and 5, where n is a positive integer. Referring back to FIG. 6, matching amplifiers 600 would have the inductance value for L2 chosen such that the input impedance approaches infinity. In addition, the inductance ratio between L1 and L2 may be chosen to provide a desired amount of gain such as unity or several dB. The distributed capacitance, resistance, and inductance for network sections 1420 of length L between matching amplifiers 600 is represented by inductances Ln, resistances Rn, and capactitances Cf and Cvf.

It may be shown that the electrical relationship between Vin and Vout for distributed phase shifter 1400 is given by $$\frac{V_{out}}{V_{in}} = \prod_{i}^{N} g_{mi} \cdot \{R_{pi} + J\omega \cdot Li\,[L_{pi} - 1/((C_{pi} + C_v i) \cdot \omega^2 \cdot Li^2)]\}$$

where N is the number of capacitor stages, ω is the frequency, L is the length of transmission line segment 1420 associated with each capacitor stage, gm is the transconductance for transistor 640, $R_0$ is the CPW resistance per length, $L_0$ is the CPW inductance per length, Cv is the parasitic capacitances of all nodes per length, and Cp is the capacitance for the selected ones of the capacitors C1 through Cn.

It may thus be seen that the selection of the capacitance value for each of the capacitors C1 through Cn depends upon the corresponding distributed impedance of the transmission line segment of length L. Given these variables, a designer may select appropriate values for C1 through Cn such that a desired phase shift range may be achieved. Referring back to FIG. 3, the control from control unit 190 depends upon the number of stages in distributed phase shifter 1400. For example, if there are eight stages, a 3-bit control signal would determine which capacitors C1 through Cn couple to the CPW transmission line.

By using metal layers M1 and M2 as seen in FIG. 12*b* to form inter-metal (integrated) capacitors C1 through Cn, each transistor switch 1410 may couple its corresponding capacitor to its transmission line segment 1420 through vias V1 through V5. The capacitor metal plates in one of the layers such as layer M2 would be tied to ground. In this fashion, when a given transistor switch 1410 is conducting, the corresponding capacitor will load its transmission line segment.

Figure 15:
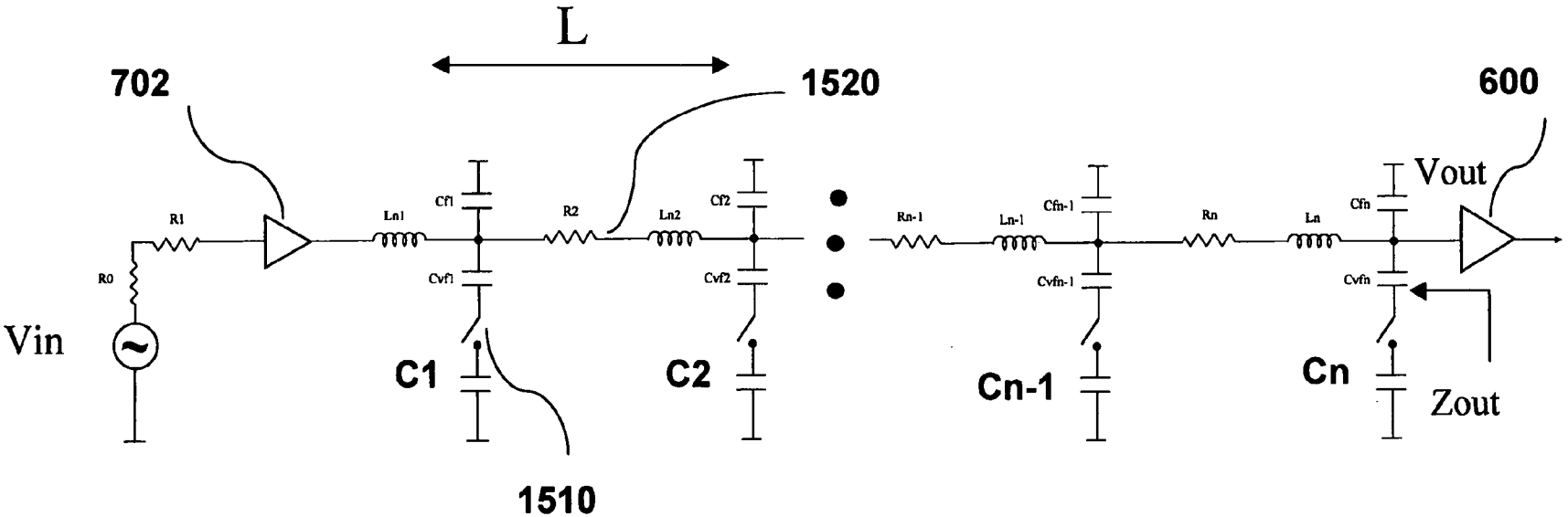
FIG. 15 is a schematic illustration of a distributed capacitor array phase shifter in accordance with an embodiment of the invention.

A simpler but lossy distributed phase shifter 1500 may be constructed as shown in FIG. 15. Phase shifter 1500 does not include a matching amplifier for each stage as discussed with respect to phase shifter 1400. However, phase shifter 1500 includes n stages having integrated capacitors C1 through Cn and corresponding transistor switches 1510. Thus, to accommodate the accompanying losses, phase shifter 1500 may include a driving amplifier 700 and an output matching amplifier 600.

Figure 16:
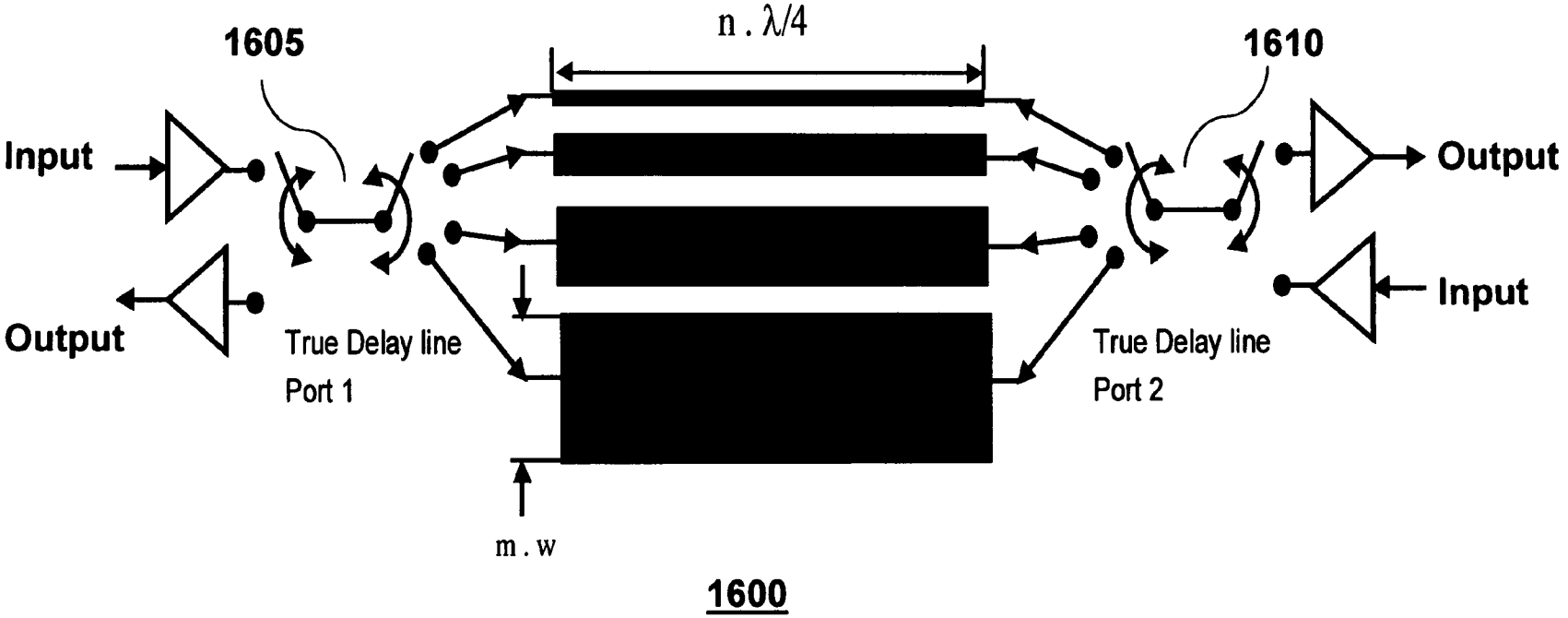
FIG. 16 is a schematic illustration of a distributed delay line phase shifter in accordance with an embodiment of the invention.

An alternative embodiment for a distributed phase-shifter is shown in FIG. 16. A phase-shifter 1600 includes an array of selectable delay lines through operation of switches 1605 and 1610. Each delay line may be implemented as a CPW conductor of appropriate width to produce the appropriate delay (and hence phase-shift). The delay through a given delay line will be a function of the width of the corresponding CPW conductor. Transistor-based switches 1605 and 1610 select for the appropriate network input or output. In that regard, it will be appreciated that in a full-duplex design in which the received and transmitted RF signals travel on the same network, the input and output ports would not be separated as seen in FIG. 16. The length of the delay lines is arbitrary and depends upon the desired phase shifts. In the embodiment illustrated, the length for each delay line is an integer multiple of a quarter wavelength for the operating frequency.

Figure 17:
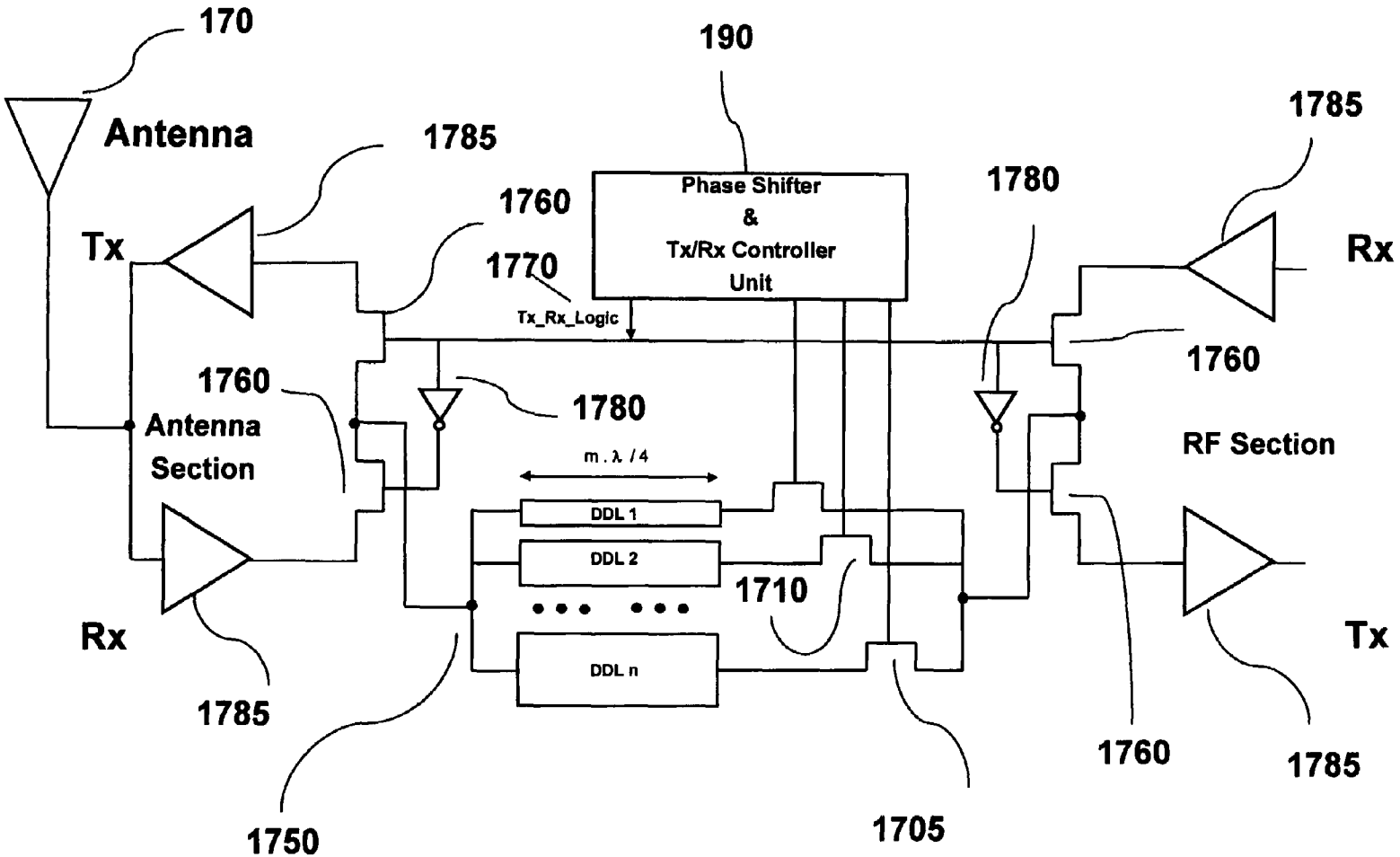
FIG. 17 is a schematic illustration of a distributed delay line phase shifter integrated with distributed amplification in accordance with an embodiment of the invention.

The distributed phase-shifter of FIG. 16 may be combined with distributed amplification in a wafer-scale-antenna-module (WSAM) embodiment as seen in FIG. 17. An RF section may contain an impulse generator (not illustrated) as described further with regard to FIG. 18. The control provided by control unit 190 (FIG. 3) to control the delay line phase shifter depends upon the number of selectable delay lines as discussed analogously with regard to FIG. 14. For example, if there are eight delay lines, a 3-bit control signal would suffice. Although delay line phase shifter 1600 of FIG. 16 includes switches 1605 and 1610 that may select for only a single delay line, it will be appreciated that multiple delay lines may be selected in parallel as seen in FIG. 17. For example, if both switches 1705 and 1710 are closed, the corresponding delay lines will simultaneously load network node 1750. A low power impulse generator (discussed with regard to FIG. 18) may provide a signal to the Rx port so that the signal may be properly delayed through the delay line phase shifter. Similarly, a received signal from antenna 170 may be phase shifted by the delay line phase shifter and provided to the Tx port of a corresponding baseband processor. Transistor switches 1760 that control such a half-duplex operation may be operated by a common control signal 1770 through use of inverters 1780. Distributed amplifiers 1785 (which may be implemented using the driver/matching configurations discussed previously) provide proper gain through the delay line phase shifter and the transmission network in both the receive and transmit configurations.

Figure 18:
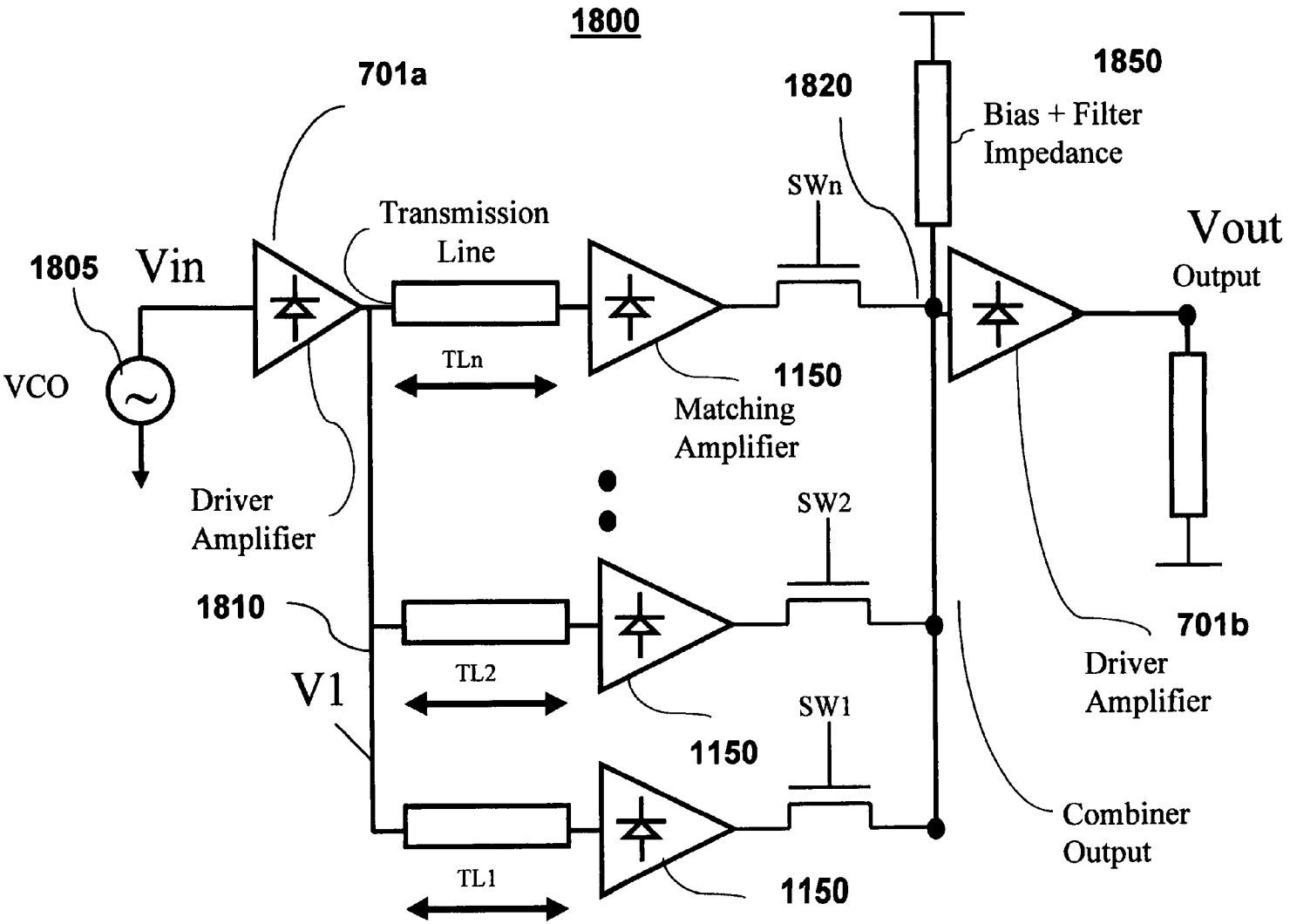
FIG. 18 is a schematic illustration of an impulse signal generator in accordance with an embodiment of the invention.

An exemplary impulse signal generator will now be discussed that advantageously may be integrated with a WSAM. Turning now to FIG. 18, an impulse generator 1800 includes an oscillator such as a VCO 1805. To generate pulses from the sinusoid produced by the VCO, the impulse generator includes a driver amplifier driving selectable delay lines whose outputs are combined through combiner matching amplifier at a node 1820. Because the sinusoids from the VCO are level-shifted and rectified (as will be explained further) and delayed through selected transmission lines TL1 through TLn, an output voltage Vout will produce pulses of a desired width. The pulse width depends upon the selected transmission lines.

Figure 7B:
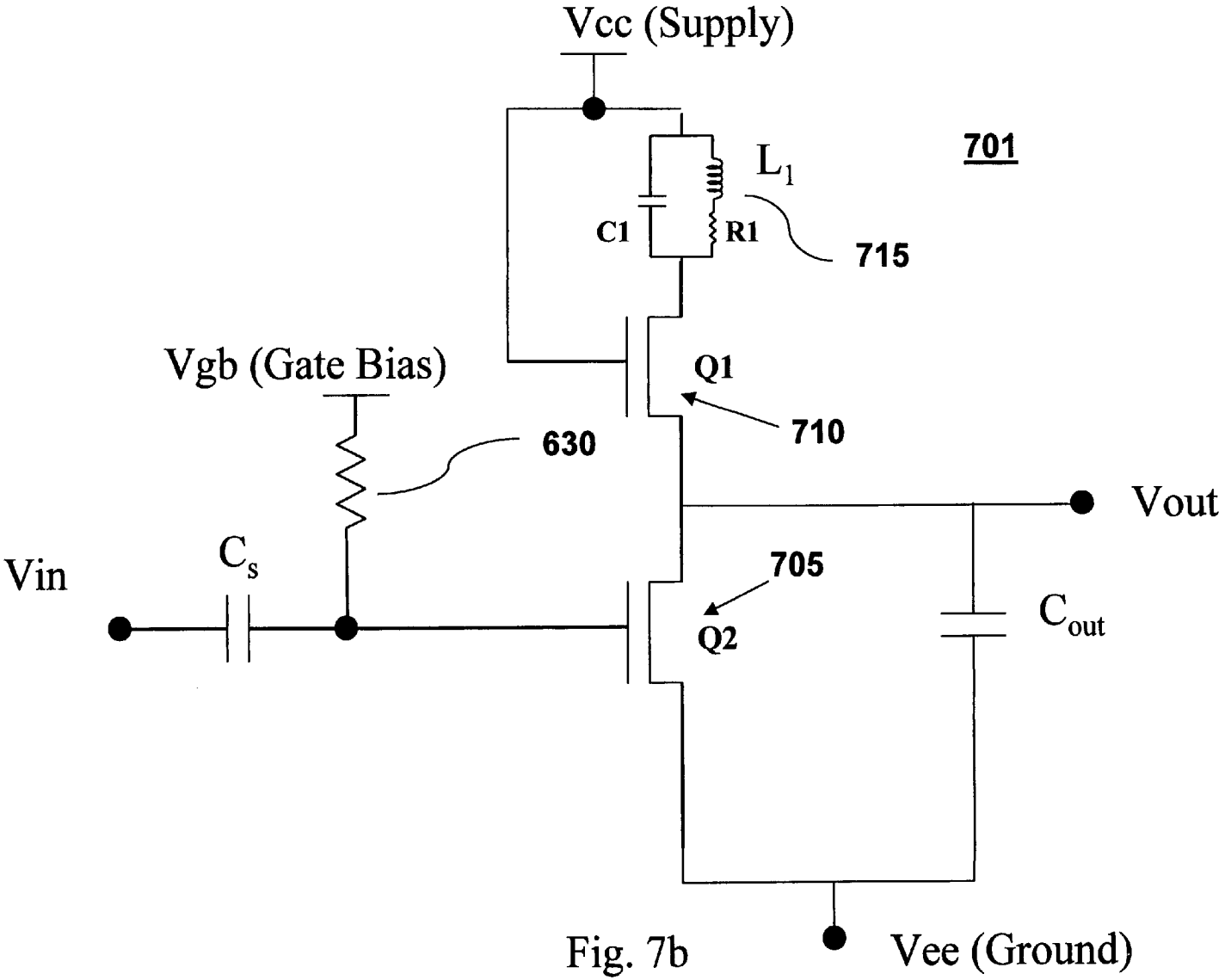
FIG. 7*b* is a schematic illustration of a driving amplifier for a pulse shaping circuit in accordance with an embodiment of the invention.
Figure 19A:
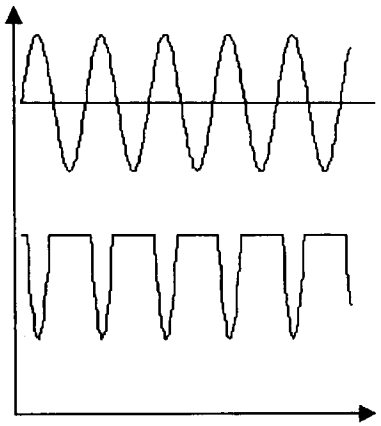
FIG. 19*a* illustrates the input and output voltage waveforms for a first driving amplifier in the impulse signal generator of FIG. 18.

To provide the rectification and level-shifting, the driver and combiner matching amplifiers are altered with regard to those discussed with regard to FIGS. 7*a* and 1 la so as to operate in the saturation mode rather than in the linear mode. Turning now to FIG. 7*b*, rectifying and level-shifting driver amplifier 701 differs from driver amplifier 700 in that the output voltage and the output capacitor couple between ground and the source (rather than the drain) of transistor Q1. Because transistor Q1 has approximately a diode drop of voltage across it (approximately 0.7 V), the output is then level-shifted this amount from VCC. The rectification comes about from the biasing of amplifier 701 such that it does not operate in the linear small-signal mode that may be assumed for amplifier 700. Instead, amplifier 701 operates in the saturation mode. In this fashion, a first amplifier 701*a* as seen in FIG. 18 shifts and rectifies its output signal at a splitting junction 1810. This level shifting and rectifying of the sinusoidal input voltage to amplifier 701*a* may be better understood with regard to FIG. 19*a*, which illustrates waveforms for both the input voltage Vin and the output voltage Vout for amplifier 701*a*. As seen in FIG. 19*a*, that the sinusoidal input signal provided by the VCO is level-shifted and rectified to form the Vout signal.

Figure 11B:
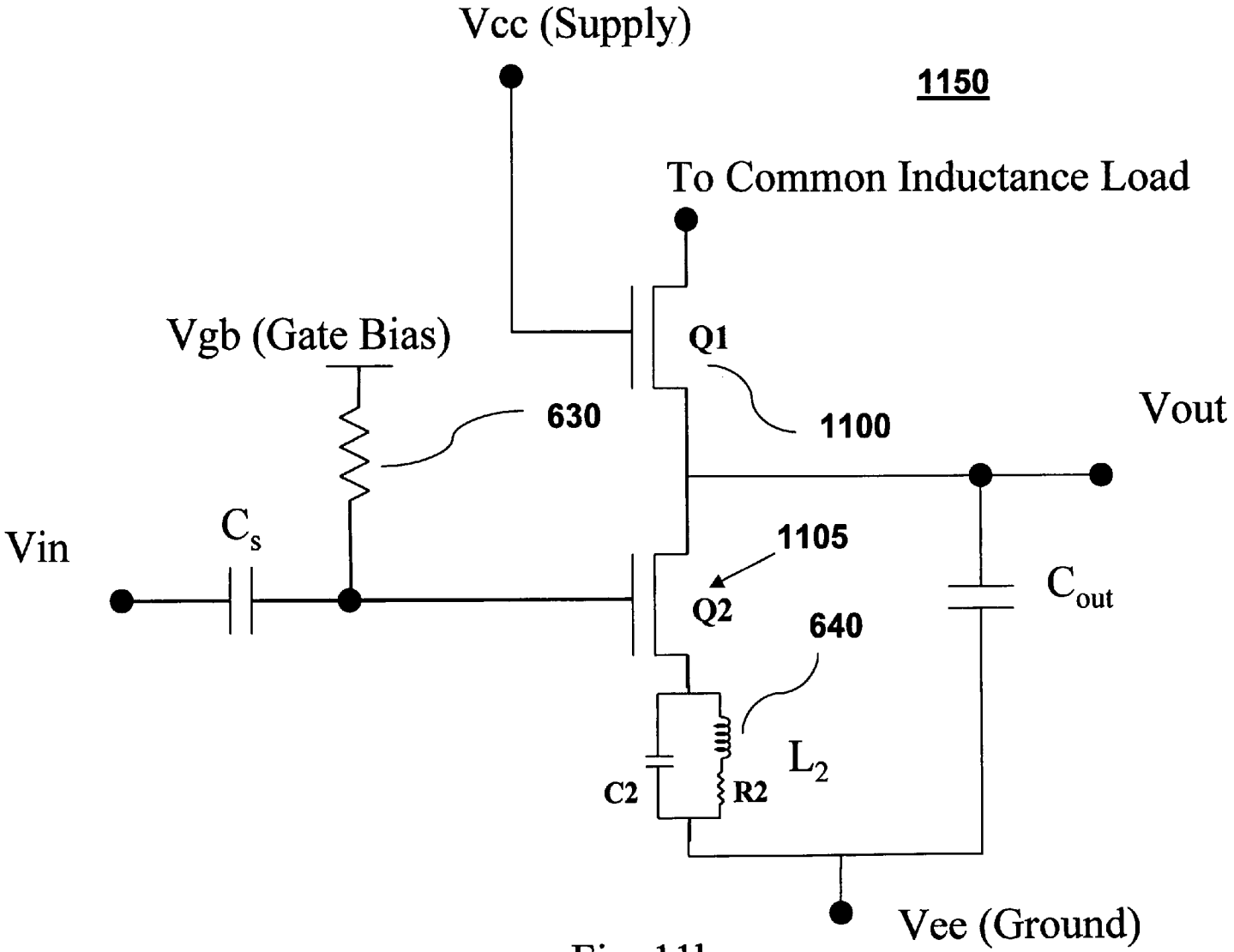
FIG. 11*b* is a schematic illustration of a matching amplifier for a pulse shaping circuit in accordance with an embodiment of the invention.

Amplifier 701 drives transmission lines TL1 through TLn (such as CPW segments) arranged in parallel between splitting junction 1810 and a combining junction 1820. These transmission lines have different electrical lengths through appropriate configuration. For example, in a CPW embodiment, the widths of the corresponding CPW conductors are varied accordingly. Each transmission line segment ends in a level-shifting and rectifying combiner matching amplifier. Turning now to FIG. 11*b*, a level-shifting and rectifying combiner matching amplifier 1150 differs from linear combiner matching amplifier 1101 of FIG. 11*a* in that the output voltage and output capacitor couple between ground and the source (rather than the drain) of transistor Q1. As discussed with regard to FIG. 7*b*, such an output configuration provides a level-shifting effect of approximately 0.7 V due to the voltage change between the drain and source of Q1. As also discussed with regard to amplifier 701, combiner matching amplifier 1150 is biased to operate in the saturation mode rather than in the linear small-signal mode. The drain of Q1 couples to a common load inductor (represented by bias and filter impedance 1850 in FIG. 18). An alternative embodiment for combiner matching amplifier 1150 may be formed by replacing the FETs with bipolar transistors.

Figure 19B:
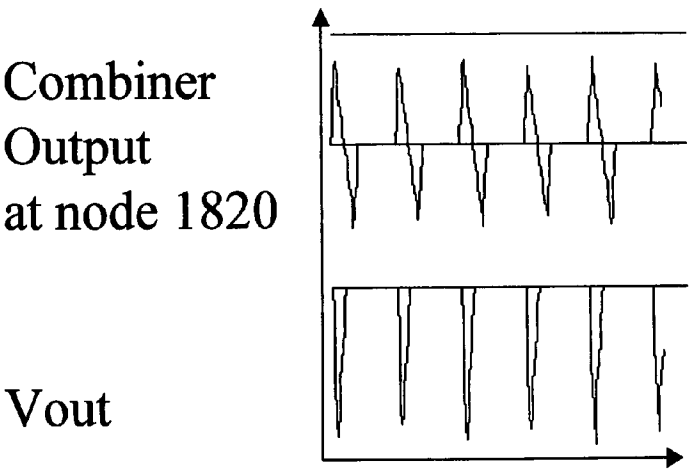
FIG. 19*b* illustrates the combining junction voltage waveforms and output voltage waveforms for the impulse signal generator of FIG. 18.

Referring again to FIG. 18, it may be seen that if combiner matching amplifiers 1150 are constructed using BJT transistors, combining junction 1820 functions as a common collector node for transistor Q1 (referring back to FIG. 11) in all the combiner matching amplifiers. Alternatively, if combiner matching amplifiers 1150 are constructed using FET transistors as illustrated in FIG. 11*b*, combining junction 1820 functions as a common source or drain node for Q1 (depending upon whether an NMOS or PMOS embodiment is implemented). Combining junction 1820 couples to the combiner matching amplifiers through corresponding switches such as FET switches SW1 through SWn. Each switch corresponds to a transmission line segment. For example, switch SW1 corresponds to transmission line segment TL1, switch SW2 to segment TL2, and so on. Depending upon which switches are activated, pulses of corresponding delay are coupled through to combining junction 1820. For example, suppose only switches SW1 and SW2 are closed. A given pulse delayed through transmission line segment/delay line TL2 will have a different delay than the same pulse delayed through transmission line segment TL1. These delayed pulses combine in a constructive and destructive fashion to produce a combined signal waveform at combining junction 1820 such as illustrated in FIG. 19*b*. This combined signal waveform is again level-shifted and rectified through a second driver amplifier 701*b* to provide an impulse signal output Vout also illustrated in FIG. 19*b*. It will thus be appreciated that, depending upon the selected delay times (corresponding to selected transmission line segments), pulse position modulation or pulse width modulation may be used to convey information on a pulse-to-pulse basis.

Figure 20:
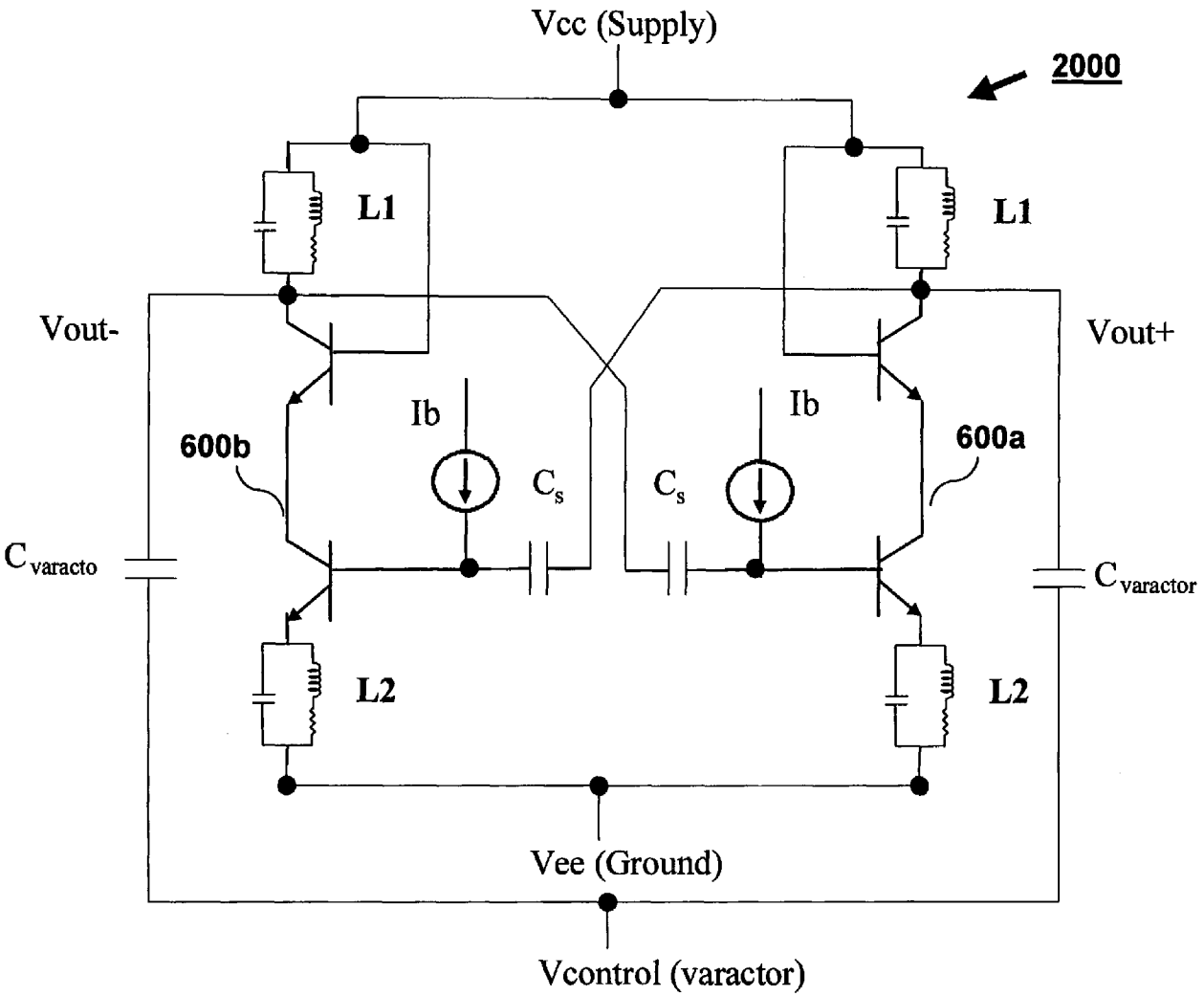
FIG. 20 is a schematic illustration of a VCO for impulse signal generator of FIG. 18.

Any suitable oscillator such as a PLL may be used in place of the VCO. However, the oscillator should be sufficiently stable such that pulse position or pulse width is stable in an unmodulated condition. If pulse position or width changes because of oscillator instability, the ability to convey information through pulse position modulation or pulse width modulation becomes impaired. Turning now to FIG. 20, an exemplary VCO 2000 includes two matching amplifiers 600 driving each other in a complementary fashion so as to induce the desired oscillation. A first matching amplifier 600*a* provides an output voltage Vout+ that is received as an input voltage to a second matching amplifier 600*b*. The second matching amplifier provides an output voltage Vout− that is received as an input voltage to the first matching amplifier. To provide an ability to tune the output frequency, the output capacitors for the matching amplifiers may be implemented with varactors driving by control voltage Vcontrol, where each varactor has a capacitance $C_{varactor}$. It may be shown that VCO 2000 will have an output frequency ω approximately equaling 1/sqrt(L*$C_{varactor}$), where L is the equivalent inductance of inductor L1 and its associated parasitic inductances. Thus, by adjusting a common control voltage Vcontrol, the output frequency for the VCO may be adjusted as necessary. To assure stability, it may be necessary to adjust L2 or L1 for one of the matching amplifiers such that the amplifiers become slightly asymmetric. If extremely narrow pulses are desired, the pulse shaping discussed with regard to FIG. 18 may be performed on a harmonic of the output frequency. For example, the VCO may be driven at 30 GHz for stability, but the matching and driver amplifiers in the impulse generator may be configured to shape a 60 GHz harmonic. As discussed previously, the matching and driver amplifiers have a center frequency that may be configured appropriately to shape pulses at the desired frequency. The pulse shaping may be performed in a single-ended fashion using either output voltages Vout+ or Vout− or may be performed in a differential fashion using both these output voltages.

Referring back to FIG. 3, the impulse signal generator may be located either on the wafer or external to the wafer. Regardless of whether the impulse signal generator is integrated with the remaining components of the WSAM, the impulse signal waveform is provided at an input port such as port 405 of FIG. 4. From this input port, the impulse signal waveform travels through the transmission network to the antennas. The resulting transmission losses may be compensated for using distributed amplification as discussed herein. However, although the transmission losses are compensated for, substantial dispersion may be incurred for the pulses as they travel across the wafer a transmission network such as a CPW network. For example, a pulse having a width of 12 picoseconds (which may be generated using the 60 GHz harmonic of VCO 2000 driven at 30 GHz) may have pulse width of 20 or more picoseconds by the time it reaches the antennas.

Figure 21:
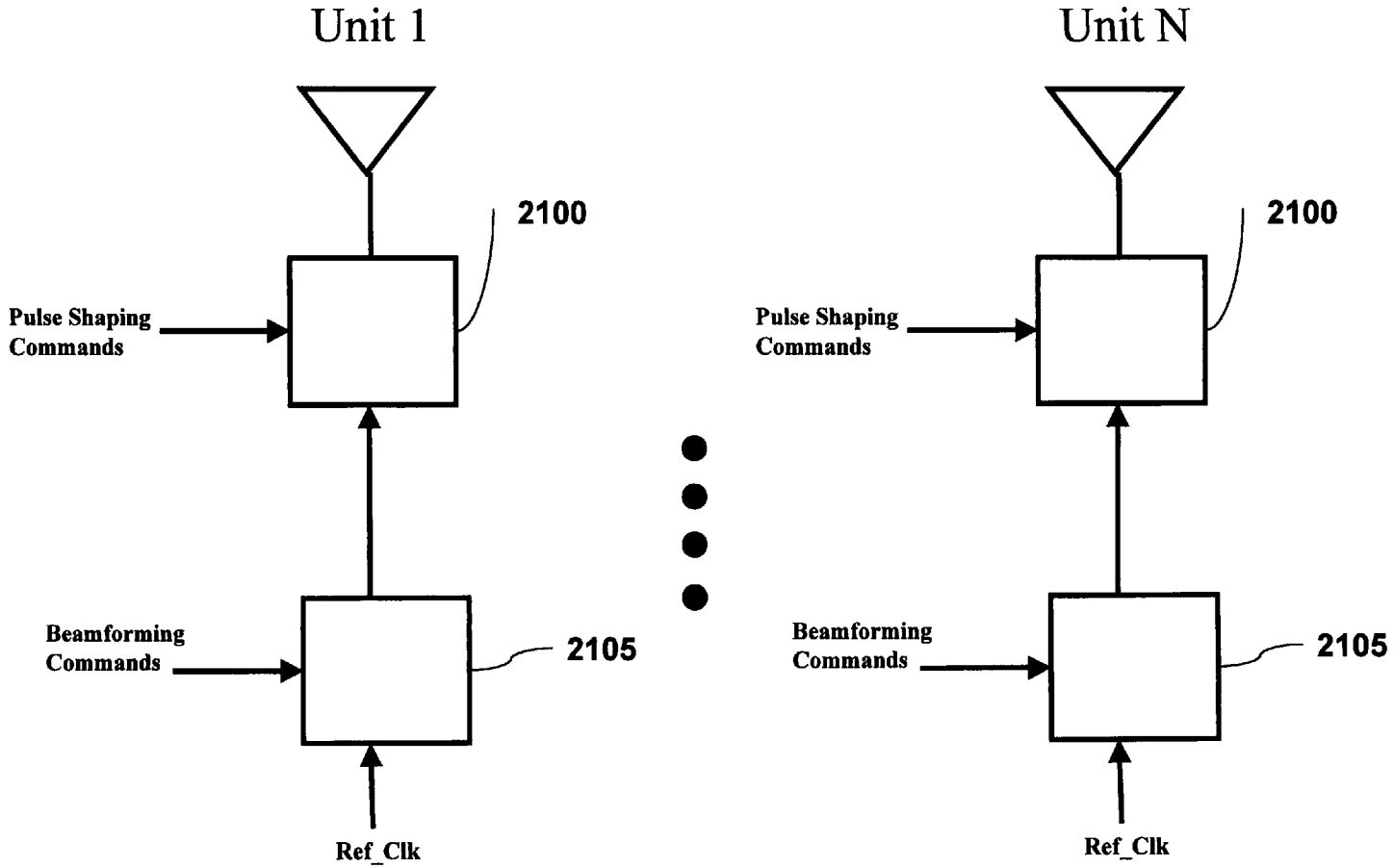
FIG. 21 is a block diagram of an integrated circuit implementation of an impulse signal generator in which each antenna is associated with its own oscillator in accordance with an embodiment of the invention.

To avoid such dispersion, each antenna may be associated with an oscillator as discussed, for example, in commonly-assigned U.S. Pat Nos. 6,982,670 and 6,870,503, the contents of which are incorporated by reference. Referring now to FIG. 21, a substrate (not illustrated) includes active circuitry that forms impulse shaping circuits 2100 and oscillators such as PLLs 2105. Each PLL 2105 thus functions as the VCO discussed with regard to FIG. 18. In that regard, each pulse-shaping circuit may be formed using the driver amplifier/matching amplifier combination with the selectable transmission line segments of FIG. 18. But note that no CPW network need be provided on the substrate to distribute the resulting pulses. Instead, the pulses may be coupled through a via to the corresponding antenna as discussed with regard to FIG. 12*a* directly from the active circuitry producing the pulses. The PLLs are kept synchronous with each other through distribution of a reference clock as discussed in commonly-assigned U.S. Pat. No. 6,870,503. Thus, the substrate may be adjacent a clock distribution waveguide network formed using metal layers. Coherent operation of the PLLs is thus assisted through transmission of a phasing signal through the clock distribution waveguide network. Each PLL may adjust the phase of its output according to a beam forming command from a controller such as discussed with regard to FIG. 1. The beam shaping commands may be generated locally or distributed using, e.g., a CPW feed network.

Figure 22:
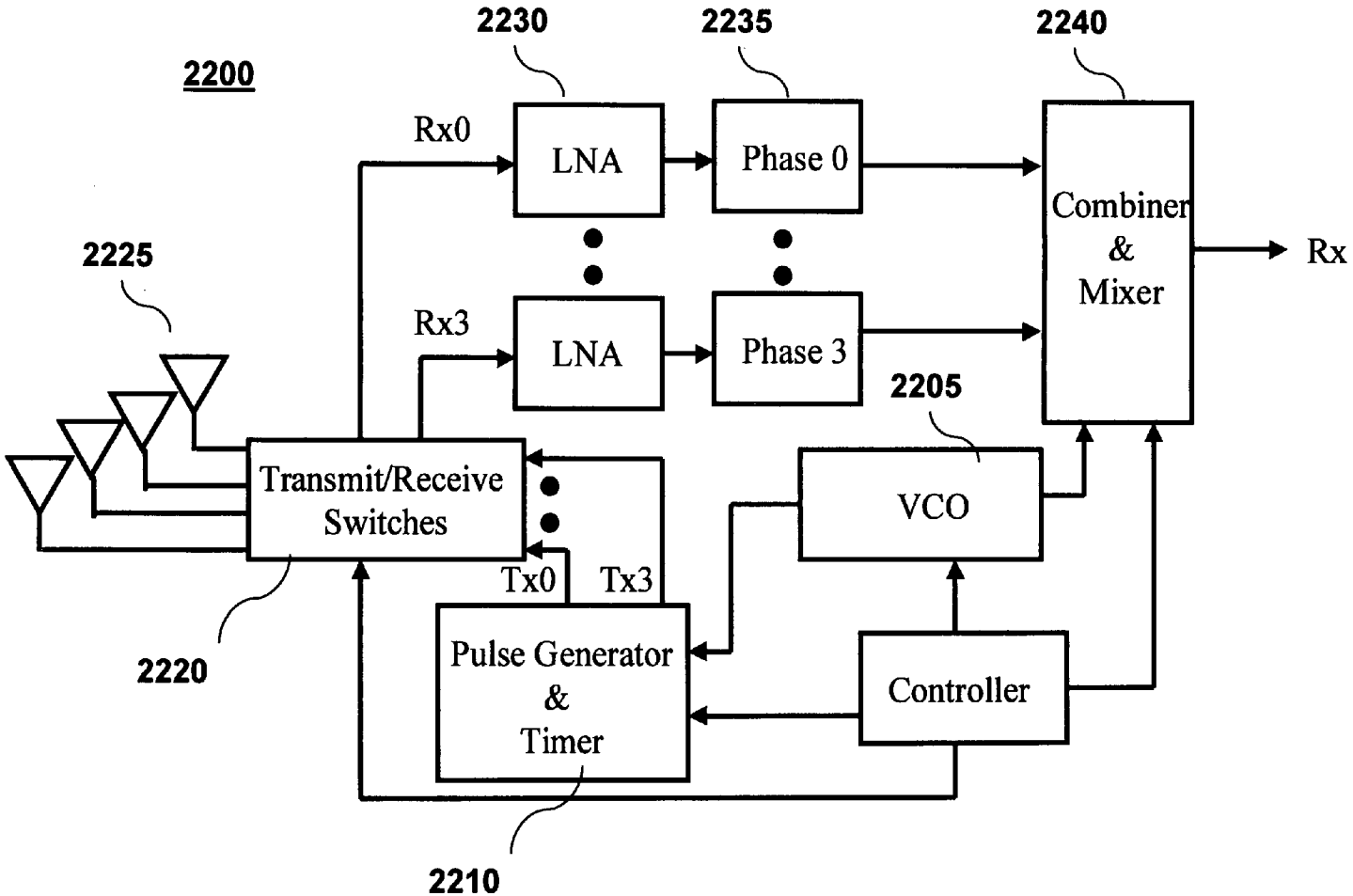
FIG. 22 is a block diagram of a multiple-input multiple-output (MIMO) impulse signal generator in accordance with an embodiment of the invention.

The impulse shaping circuit disclosed herein may be integrated into a multiple-input multiple-output (MIMO) embodiment. Turning now to FIG. 22, a MIMO 2200 is illustrated that includes a VCO 2205. VCO 2205 functions as VCO 1805 of FIG. 18. However, it feeds separate pulse shaping circuits 1800 (represented collectively by pulse generator 2210). The number of pulse shaping circuits depends upon the number of output channels desired. For example, four output channels may be produced by four pulse shaping circuits. A first pulse shaping provides pulses at a first pulse position designated by Tx0, and so on such that a fourth pulse shaping circuit provides pulses at a fourth pulse position designated by Tx3. For example, the pulse repetition period may be divided into four sub-periods. The first pulse position corresponds to the initial sub-period whereas the fourth pulse corresponds to the fourth and final sub-period. These pulses are coupled through transmit and receive switches 2220 to the desired antennas 2225. On the return side, the multiple outputs (as received though separate channels) couple through low noise amplifiers 2230 into delay circuits 2235. These delay circuits may be constructed as discussed with regard to FIG. 18 except that the signal source (VCO 1805) is replaced by the receiving antennas. In this fashion, a received pulse may have its pulse position information demodulated through sampling of the output channels at a combiner and mixer stage 2240. MIMO 2200 may be advantageously integrated into a wafer scale embodiment using the distributed amplification and transmission network features discussed previously.

It will be obvious to those skilled in the art that various changes and modifications may be made without departing from this invention in its broader aspects. The appended claims encompass all such changes and modifications as fall within the true spirit and scope of this invention.

I claim:

1. An impulse radio, comprising:

a signal source operable to provide a sinusoidal source signal;

a pulse shaping circuit having a plurality of selectable delay paths, the pulse shaping circuit being configured to rectify and level shift the sinusoidal source signal through selected ones of the selectable delay paths to provide an impulse signal output;

a substrate;

a plurality of antennas adjacent the substrate;

an RF feed network adjacent the substrate and coupled to the pulse shaping circuit, the RF feed network being configured to transmit the impulse signal output to the plurality of antennas, and a distributed plurality of amplifiers integrated with the substrate and operable to amplify the impulse signal output propagated through the RF feed network.

2. The impulse radio of claim 1, wherein the substrate is a semiconductor wafer.

3. The impulse radio of claim 1, wherein the RF feed network is implemented using waveguides selected from the group consisting of microstrip waveguides, co-planar waveguides, and planar waveguides.

4. The impulse radio of claim 3, wherein the antenna arrays are adjacent a first side of the substrate and wherein the RF feed network is a co-planar waveguide network adjacent an opposing surface of the substrate, the distributed plurality of amplifiers being integrated into the opposing surface.

5. The impulse radio of claim 4, wherein the co-planar waveguide is formed in semiconductor processing metal layers adjacent the opposing surface of the substrate.

6. The impulse radio of claim 5, wherein the distributed plurality of amplifiers comprises a plurality of driver amplifiers and matching amplifiers arranged in pairs, the co-planar waveguide being segmented into transmission line segments, each segment corresponding to a driver amplifier and matching amplifier pair, the driver amplifier being operable to drive the impulse signal output through the segment to the corresponding matching amplifier, the matching amplifier being operable to match an impedance of the corresponding transmission line segment to a desired impedance.

7. The impulse radio of claim 2, wherein the signal source and the pulse shaping circuits are integrated into the wafer substrate.

8. The impulse radio of claim 2, wherein the signal source and the pulse shaping circuits are external to the wafer substrate.

9. The impulse radio of claim 2, wherein the plurality of antennas are arranged into groups, the impulse radio further comprising: a plurality of phase-shifters integrated with the wafer substrate corresponding on a one-to-one basis with the groups of antennas, each phase-shifter being operable to phase-shift the impulse signal output being propagated through the RF feed network to the phase-shifter's group of antennas responsive to a phase-shift command, whereby a transmitted impulse signal from the antennas is beam steered according to the phase-shift commands.

10. The impulse radio of claim 9, wherein each phase-shifter comprises a plurality of selectable delay lines.

11. The impulse radio of claim 9, wherein each phase-shifter comprises a distributed phase-shifter, each distributed phase-shifter including a plurality of capacitors coupled to the RF feed network through a corresponding plurality of switches such that if one of the switches is activated, the corresponding capacitor will load the RF feed network and thereby phase-shift the impulse signal output being propagated through the RF feed network to the distributed phase-shifter's group of antennas.

12. The impulse radio of claim 11, wherein the plurality of antennas are adjacent a first surface of the wafer substrate and wherein the RF feed network is a co-planar waveguide network adjacent an opposing second surface of the wafer substrate, the plurality of distributed amplifiers and distributed phase-shifters being included in active circuitry integrated into the opposing second surface.

13. The impulse radio of claim 12, wherein the capacitors are inter-metal capacitors formed in metal layers adjacent the opposing second surface of the wafer substrate.

14. The impulse radio of claim 13, wherein for each phase shifter, the capacitors are separated by segments of the corresponding coplanar waveguide network, the phase shifter including a plurality of matching amplifiers corresponding to the segments, each phase-shifter's matching amplifier being configured to match an output impedance of its corresponding segment of coplanar waveguide to a desired impedance value.

15. An impulse signal transmitter, comprising:

a substrate;

a plurality of impulse signal generators integrated into the substrate, each impulse signal generator including a signal source operable to provide a sinusoidal source signal and a pulse shaping circuit having a plurality of selectable delay paths, the pulse shaping circuit being configured to rectify and level shift the sinusoidal source signal through selected ones of the selectable delay paths to provide an impulse signal output;

and a plurality of antennas formed adjacent the substrate corresponding to the plurality of signal generators, each impulse signal generator being operable to drive its antenna with it impulse signal output.

16. A multiple-input multiple-output (MIMO) circuit, comprising:

a wafer substrate;

a transmission network adjacent to the substrate defining multiple channels;

a VCO integrated with the substrate;

a plurality of pulse-shaping circuits integrated with the substrate, each pulse-shaping circuit adapted to level-shift and delay versions of an output signal from the VCO to provide pulses, wherein each pulse-shaping circuit is adapted to drive a corresponding channel in the transmission network; and a plurality of antennas adjacent to the substrate, each antenna coupled to a corresponding channel in the transmission network.

* * * * *